US006386955B2

(12) United States Patent
Zuniga et al.

(10) Patent No.: US 6,386,955 B2
(45) Date of Patent: May 14, 2002

(54) CARRIER HEAD WITH A FLEXIBLE MEMBRANE FOR A CHEMICAL MECHANICAL POLISHING SYSTEM

(75) Inventors: Steven M. Zuniga, Soquel; Manoocher Birang, Los Gatos; Hung Chen, San Jose; Sen-Hou Ko, Cupertino, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/730,944

(22) Filed: Dec. 5, 2000

Related U.S. Application Data

(63) Continuation of application No. 08/861,260, filed on May 21, 1997, now Pat. No. 6,183,354, which is a continuation of application No. 08/745,679, filed on Nov. 8, 1996, now abandoned.

(51) Int. Cl.[7] ..... B24B 1/00

(52) U.S. Cl. ..... 451/56; 451/398; 451/287; 451/41

(58) Field of Search ..... 451/285, 41, 287, 451/288, 289, 36, 42, 290, 397, 398, 256, 259, 247, 401, 332, 292, 56

(56) References Cited

U.S. PATENT DOCUMENTS

| | | | |
|---|---|---|---|
| 4,373,991 | A | 2/1983 | Banks |
| 4,918,869 | A | 4/1990 | Kitta |
| 5,081,795 | A | 1/1992 | Tanaka et al. |
| 5,193,316 | A | 3/1993 | Olmstead |
| 5,205,082 | A | 4/1993 | Shendon et al. |
| 5,230,184 | A | 7/1993 | Bukhman |
| 5,423,558 | A | 6/1995 | Koeth et al. |
| 5,423,716 | A | 6/1995 | Strasbaugh |
| 5,441,444 | A | 8/1995 | Nakajima |
| 5,443,416 | A | 8/1995 | Volodarsky et al. |
| 5,449,316 | A | 9/1995 | Strasbaugh |
| 5,476,414 | A | 12/1995 | Hirose et al. |
| 5,498,199 | A | 3/1996 | Karlsrud et al. |
| 5,584,751 | A | 12/1996 | Kobayashi et al. |
| 5,624,299 | A | 4/1997 | Shendon |
| 5,643,053 | A | 7/1997 | Shendon |
| 5,643,061 | A | 7/1997 | Jackson et al. |
| 5,738,574 | A | 4/1998 | Tolles et al. |
| 5,759,918 | A | 6/1998 | Hoshizaki et al. |
| 5,762,539 | A | 6/1998 | Nakashiba et al. |
| 5,762,544 | A | 6/1998 | Zuniga et al. |
| 5,803,799 | A | 9/1998 | Volodarsky et al. |

(List continued on next page.)

FOREIGN PATENT DOCUMENTS

| | | |
|---|---|---|
| DE | 8631078 | 4/1987 |
| EP | 0 156 746 A1 | 10/1985 |
| EP | 0 653 270 A1 | 5/1995 |
| EP | 0 841 123 | 5/1998 |
| JP | 61-25768 | 2/1986 |
| JP | 63-114870 | 5/1988 |
| JP | 63-300858 | 12/1988 |
| JP | 1-216768 | 8/1989 |
| JP | 2-224263 | 9/1990 |
| JP | 2243263 | 9/1990 |
| JP | 05 277929 | 10/1993 |
| WO | WO 96/36459 | 11/1996 |
| WO | WO 99/07516 | 2/1999 |

*Primary Examiner*—Derris H. Banks
(74) *Attorney, Agent, or Firm*—Fish & Richardson

(57) ABSTRACT

A carrier head for a chemical mechanical polishing apparatus. The carrier head includes a housing, a base, a loading mechanism, a gimbal mechanism, and a substrate backing assembly. The substrate backing assembly includes a support structure positioned below the base, a substantially horizontal, annular flexure connecting the support structure to the base, and a flexible membrane connected to the support structure. The flexible membrane has a mounting surface for a substrate, and extends beneath the base to define a chamber.

10 Claims, 20 Drawing Sheets

U.S. PATENT DOCUMENTS 5,851,140 A 12/1998 Barns et al.
5,879,220 A 3/1999 Hasegawa et al.
5,931,725 A * 8/1999 Inaba et al. ..... 451/398
5,957,751 A 9/1999 Govzman et al.
5,964,653 A 10/1999 Perlov et al.
6,080,050 A 6/2000 Chen et al.
6,132,298 A 10/2000 Zuniga et al.
6,146,259 A 11/2000 Zuniga et al.
6,159,079 A 12/2000 Zuniga et al.
6,162,116 A 12/2000 Zuniga et al.
6,165,058 A 12/2000 Zuniga et al.
6,183,354 B1 * 2/2001 Zuniga et al. ..... 451/285
6,210,255 B1 4/2001 Zuniga et al.

* cited by examiner

| 4A | 4B |
|---|---|

| FIG. 6A |
| --- |
| FIG. 6B |

CARRIER HEAD WITH A FLEXIBLE MEMBRANE FOR A CHEMICAL MECHANICAL POLISHING SYSTEM

This a continuation application of U.S. application Ser. No. 08/861,260, filed May 21, 1997, now U.S. Pat. No. 6,183,354, which is a continuation of U.S. patent application Ser. No. 08/745,679, filed Nov. 8, 1996, now abandoned, each of which are hereby incorporated by reference.

BACKGROUND OF THE INVENTION

The present invention relates generally to chemical mechanical polishing of substrates, and more particularly to a carrier head for a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer. If the outer surface of the substrate is non-planar, then a photoresist layer placed thereon is also non-planar. A photoresist layer is typically patterned by a photolithographic apparatus that focuses a light image onto the photoresist. If the outer surface of the substrate is sufficiently non-planar, then the maximum height difference between the peaks and valleys of the outer surface may exceed the depth of focus of the imaging apparatus, and it will be impossible to properly focus the light image onto the outer substrate surface.

It may be prohibitively expensive to design new photolithographic devices having an improved depth of focus. In addition, as the feature size used in integrated circuits becomes smaller, shorter wavelengths of light must be used, resulting in a further reduction of the available depth of focus. Therefore, there is a need to periodically planarize the substrate surface to provide a substantially planar layer surface.

Chemical mechanical polishing (CMP) is one accepted method of planarization. This planarization method typically requires that the substrate be mounted to a carrier or polishing head. The exposed surface of the substrate is then placed against a rotating polishing pad. The carrier provides a controllable load, i.e., pressure, on the substrate to press it against the polishing pad. In addition, the carrier may rotate to provide additional motion between the substrate and polishing pad. A polishing slurry, including an abrasive and at least one chemically-reactive agent, may be distributed over the polishing pad to provide an abrasive chemical solution at the interface between the pad and substrate.

A CMP process is fairly complex, and differs from simple wet sanding. In a CMP process, the reactive agent in the slurry reacts with the outer surface of the substrate to form reactive sites. The interaction of the polishing pad and abrasive particles with the reactive sites results in polishing.

An effective CMP process has a high polishing rate and generates a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad. Because inadequate flatness and finish can create defective substrates, the selection of a polishing pad and slurry combination is usually dictated by the required finish and flatness. Given these constraints, the polishing rate sets the maximum throughput of the polishing apparatus.

The polishing rate depends upon the force pressing the substrate against the pad. Specifically, the greater this force, the higher the polishing rate. If the carrier head applies a non-uniform load, i.e., if the carrier head applies more force to one region of the substrate than to another, then the high pressure regions will be polished faster than the low pressure regions. Therefore, a non-uniform load may result in non-uniform polishing of the substrate.

An additional consideration in the production of integrated circuits is process and product stability. To achieve a high yield, i.e., a low defect rate, each successive substrate should be polished under substantially similar conditions. Each substrate should be polished by approximately the same amount so that each integrated circuit is substantially identical.

In view of the foregoing, there is a need for a chemical mechanical polishing apparatus which optimizes polishing throughput while providing the desired flatness and finish. Specifically, the chemical mechanical polishing apparatus should have a carrier head which applies a substantially uniform load across the substrate.

SUMMARY OF THE INVENTION

In one aspect, the present invention is directed to a carrier head for a chemical mechanical polishing apparatus. The carrier head comprises a base, a support structure connected to the base by a flexure, and a flexible membrane connected to the support structure. The flexible membrane has a mounting surface for a substrate and extends beneath the support structure to define a chamber.

Implementations of the invention include the following. The flexure may be secured between an upper clamp and a lower clamp, and the membrane may be secured between the lower clamp and the support structure. The flexure may be substantially horizontal and annular, with an outer circumferential portion attached to the base and an inner circumferential portion attached to the support structure. The support structure may include an annular ring or a circular plate. A portion of the chamber above the plate may be connected by an aperture through the plate to a portion below. An outer edge of the support structure may have a downwardly projecting lip.

The carrier head may include one or more of the following: a housing connectable to a drive shaft to rotate therewith, a gimbal mechanism pivotally connecting the housing to the base to permit the base to pivot with respect to the housing, a retaining ring connected to the base and surrounding the flexible membrane, and a loading mechanism connecting the housing to the base to apply a downward pressure to the base. The housing may have a substantially vertical passage, and the gimbal mechanism may include a rod with its upper end slidable disposed in the passage. The gimbal mechanism may include a bearing base with a spherical outer surface connected to a lower end of the rod and a gimbal race with a spherical inner surface engaging the bearing base.

The support structure, flexure and membrane may be configured such that a downward pressure on the flexure is substantially balanced by an upward pressure on the support structure so that a downward pressure at the edge of the membrane is substantially the same as a downward pressure at other portions of the membrane. A surface area of the lower surface the support structure may be approximately equal to a surface area of the upper surface of the flexure. An outer diameter of the clamp may be less than an outer diameter of the support structure.

There may be a gap between the support structure and the flexure, and there may be a passage through the support structure to carrying a fluid into the gap to force a slurry out of the gap.

In another aspect, to a carrier head includes a housing, a base, a loading mechanism, and a gimbal mechanism. The gimbal mechanism includes a rod having an upper end slidably disposed in the passage in the housing, and a slightly flexible member connecting a lower end of the rod to the base.

Implementations of the invention include the following. The member may be a ring with an inner circumferential portion connected to the rod and an outer circumferential portion connected to the base. The member may be bendable vertically but is rigid radially. A stop may be connected to the upper end of the rod to limit downward travel of the base.

In another aspect, a carrier head includes a housing, a base, a loading mechanism connecting the housing to the base to control the vertical position of the base relative to the housing, and a cushion attached to a lower surface of the housing to stop an upward motion of the base.

In another aspect, the carrier head includes a base, a first flexible membrane, and a second flexible membrane. The first membrane has a mounting surface for a substrate and defines a first chamber. The second membrane is connected to the base and positioned above the first membrane to define a second chamber. The second membrane is positioned to exert a downward pressure on the first membrane when fluid is forced into the second chamber.

Implementations of the invention include the following. The first membrane may be attached to a support structure which is connected to the base by a flexure. The second membrane may be positioned to contact either the support structure or the first membrane. A support structure may be connected to the base by a flexure, and the first membrane may be attached to and extend beneath the support structure to define the first chamber. The support structure may include a support ring, and the second membrane may be positioned to extend through the center of the support ring to contact the first membrane. The carrier head may be used in a polishing apparatus with a first fluid supply connected to the first chamber, a second fluid supply connected to the second passage, and a sensor for measuring a pressure in the second chamber.

In another aspect, the carrier head includes a base, a support structure connected to the base by a flexure, a first membrane portion, and a second membrane portion. The first membrane portion is connected to and extends beneath the base to define a first substantially circular chamber. The second membrane portion is connect to and extends beneath the support structure to define a second substantially annular chamber surrounding the first chamber.

Implementations of the invention include the following. A lower surface of the first membrane portion may contact or be attached to an upper surface of the second membrane portion.

In another aspect, the carrier head has a support structure having a bottom face, a flexible membrane defining a chamber, and a port for applying a vacuum to the chamber. There is a recessed region in the bottom face of the support structure. The membrane is arranged and configured to be pulled into the recessed region if the chamber is evacuated to produce a reduced pressure area between the flexible membrane and an upper surface of a substrate. The recessed region distributed in an asymmetrical fashion.

In another aspect, the invention is directed to a method of sensing the presence of a substrate in a carrier head. A first chamber, formed by a first flexible membrane having a mounting surface for the substrate, is pressurized. A second chamber formed by a second flexible membrane to a first pressure is also pressurized. The second membrane is positioned to contact the first membrane above the mounting surface. The second chamber is sealed. A substrate is placed against the mounting surface, and fluid is forced out of the first chamber to create a reduced pressure region to chuck the substrate to the mounting surface. Then the pressure in the second chamber is measured a second time.

Implementations include the following. If the second pressure is greater than the first pressure, then the substrate may be indicated as present. If the second pressure is equal to the first pressure, the substrate may be indicated as missing.

In another aspect, the invention is directed to a method of chucking a substrate to a mounting surface of a carrier head. A substrate is positioned against a mounting surface of a carrier head. Fluid is forced into a first chamber defined by a first flexible membrane to apply a downward pressure to an annular area of substrate, and fluid is forced out of a second chamber defined by a second membrane to pull the second membrane upwardly and create a reduced pressure region bounded by the annular area to chuck the substrate to the mounting surface.

Implantations of the invention include the following. The first membrane may contact either the substrate, a support structure, or the second membrane. The first chamber may include an annular volume.

Advantages of the invention include the following. The carrier head applies a uniform load to the substrate. The carrier head is able to vacuum-chuck the substrate to lift it off the polishing pad.

Additional advantages of the invention will be set forth in the description which follows, and in part will be obvious from the description, or may be learned by practice of the invention. The advantages of the invention may be realized by means of the instrumentalities and combinations particularly pointed out in the claims.

BRIEF DESCRIPTION OF THE DRAWINGS

The accompanying drawings, which are incorporated in and constitute a part of the specification, schematically illustrate the present invention, and together with the general description given above and the detailed description given below, serve to explain the principles of the invention.

DESCRIPTION OF THE PREFERRED EMBODIMENT(S)

Figure 1:
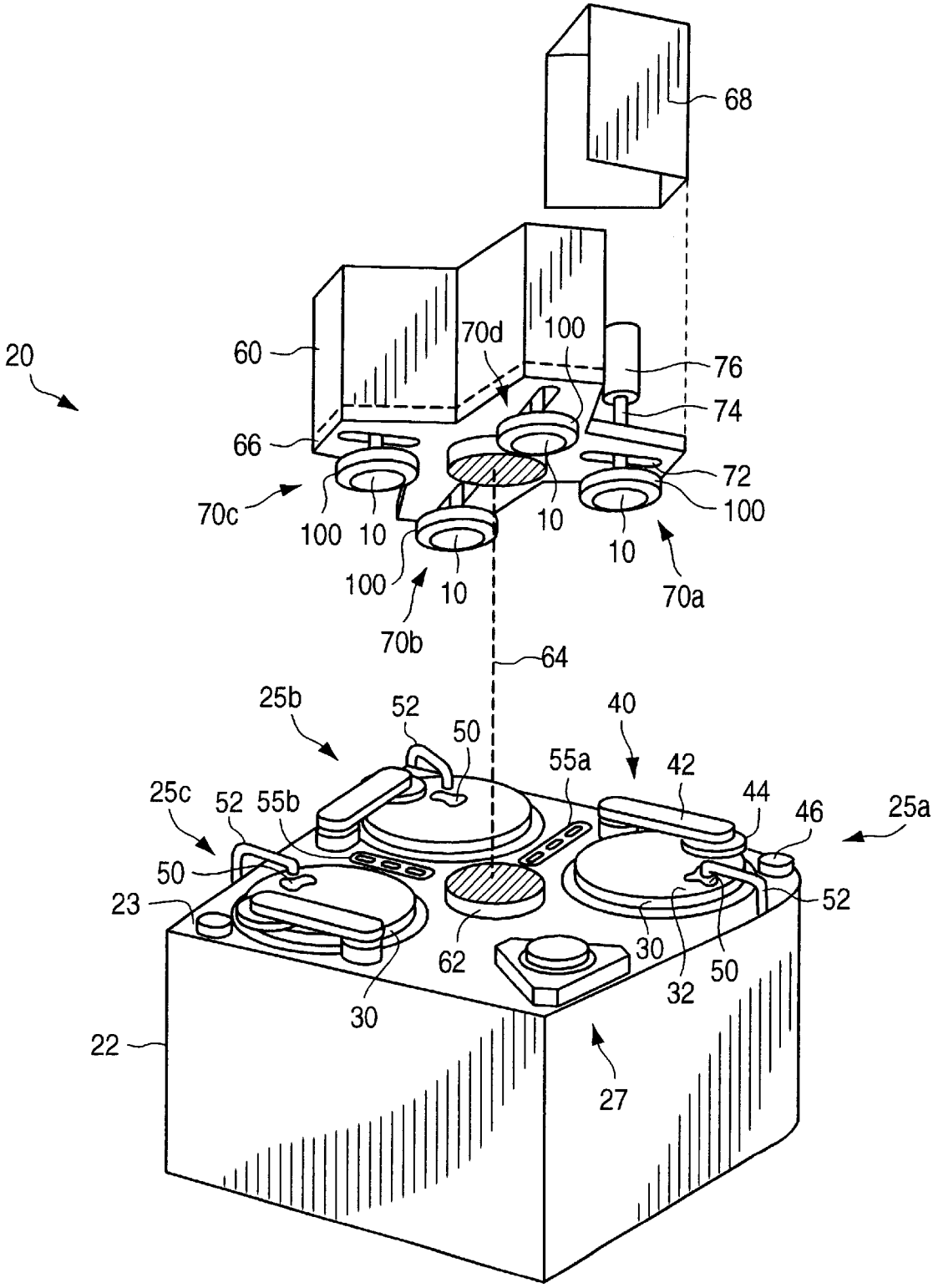
FIG. 1 is an exploded perspective view of a chemical mechanical polishing apparatus.

Referring to FIG. 1, one or more substrates 10 will be polished by a chemical mechanical polishing (CMP) apparatus 20. A complete description of CMP apparatus 20 may be found in U.S. patent application Ser. No. 08/549,336, by Perlov, et al., filed Oct. 27, 1996, entitled CONTINUOUS PROCESSING SYSTEM FOR CHEMICAL MECHANICAL POLISHING, and assigned to the assignee of the present invention, the entire disclosure of which is hereby incorporated by reference.

According to the invention, CMP apparatus 20 includes a lower machine base 22 with a table top 23 mounted thereon and a removable upper outer cover (not shown). Table top 23 supports a series of polishing stations 25*a,* 25*b* and 25*c,* and a transfer station 27. Transfer station 27 forms a generally square arrangement with the three polishing stations 25*a,* 25*b* and 25*c.* Transfer station 27 serves multiple functions of receiving individual substrates 10 from a loading apparatus (not shown), washing the substrates, loading the substrates into carrier heads (to be described below), receiving the substrates from the carrier heads, washing the substrates again, and finally transferring the substrates back to the loading apparatus.

Each polishing station 25*a*–25*c* includes a rotatable platen 30 on which is placed a polishing pad 32. If substrate 10 is an eight-inch (200 mm) diameter disk, then platen 30 and polishing pad 32 will be about twenty inches in diameter. Platen 30 is preferably a rotatable aluminum or stainless steel plate connected by a stainless steel platen drive shaft (not shown) to a platen drive motor (also not shown). For most polishing processes, the drive motor rotates platen 30 at about thirty to two-hundred revolutions per minute, although lower or higher rotational speeds may be used.

Polishing pad 32 may be a composite material with a roughened polishing surface. The polishing pad 32 may be attached to platen 30 by a pressure-sensitive adhesive layer. Polishing pad 32 may have a fifty mil thick hard upper layer and a fifty mil thick softer lower layer. The upper layer is preferably a material composed of polyurethane mixed with other fillers. The lower layer is preferably a material composed of compressed felt fibers leached with urethane. A common two-layer polishing pad, with the upper layer composed of IC-1000 and the lower layer composed of SUBA-4, is available from Rodel, Inc., located in Newark, Del. (IC-1000 and SUBA-4 are product names of Rodel, Inc.).

Each polishing station 25*a*–25*c* may further include an associated pad conditioner apparatus 40. Each pad conditioner apparatus 40 has a rotatable arm 42 holding an independently rotating conditioner head 44 and an associated washing basin 46. The conditioner apparatus maintains the condition of the polishing pad so that it will effectively polish any substrate pressed against it while it is rotating.

A slurry 50 containing a reactive agent (e.g., deionized water for oxide polishing), abrasive particles (e.g., silicon dioxide for oxide polishing) and a chemically-reactive catalyzer (e.g., potassium hydroxide for oxide polishing), is supplied to the surface of polishing pad 32 by a slurry supply tube 52. Sufficient slurry is provided to cover and wet the entire polishing pad 32. Two or more intermediate washing stations 55*a* and 55*b* are positioned between neighboring polishing stations 25*a,* 25*b* and 25*c.* The washing stations rinse the substrates as they pass from one polishing station to another.

A rotatable multi-head carousel 60 is positioned above lower machine base 22. Carousel 60 is supported by a center post 62 and rotated thereon about a carousel axis 64 by a carousel motor assembly located within base 22. Center post 62 supports a carousel support plate 66 and a cover 68. Multi-head carousel 60 includes four carrier head systems 70*a,* 70*b,* 70*c,* and 70*d.* Three of the carrier head systems receive and hold substrates and polish them by pressing them against the polishing pad 32 on platen 30 of polishing stations 25*a*–25*c.* One of the carrier head systems receives a substrate from and delivers the substrate to transfer station 27.

The four carrier head systems 70*a*–70*d* are mounted on carousel support plate 66 at equal angular intervals about carousel axis 64. Center post 62 allows the carousel motor to rotate the carousel support plate 66 and to orbit the carrier head systems 70*a*–70*d,* and the substrates attached thereto, about carousel axis 64.

Each carrier head system 70*a*–70*d* includes a polishing or carrier head 100. Each carrier head 100 independently rotates about its own axis, and independently laterally oscillates in a radial slot 72 formed in carousel support plate 66. A carrier drive shaft 74 connects a carrier head rotation motor 76 to carrier head 100 (shown by the removal of one-quarter of cover 68). There is one carrier drive shaft and motor for each head.

Figure 2:
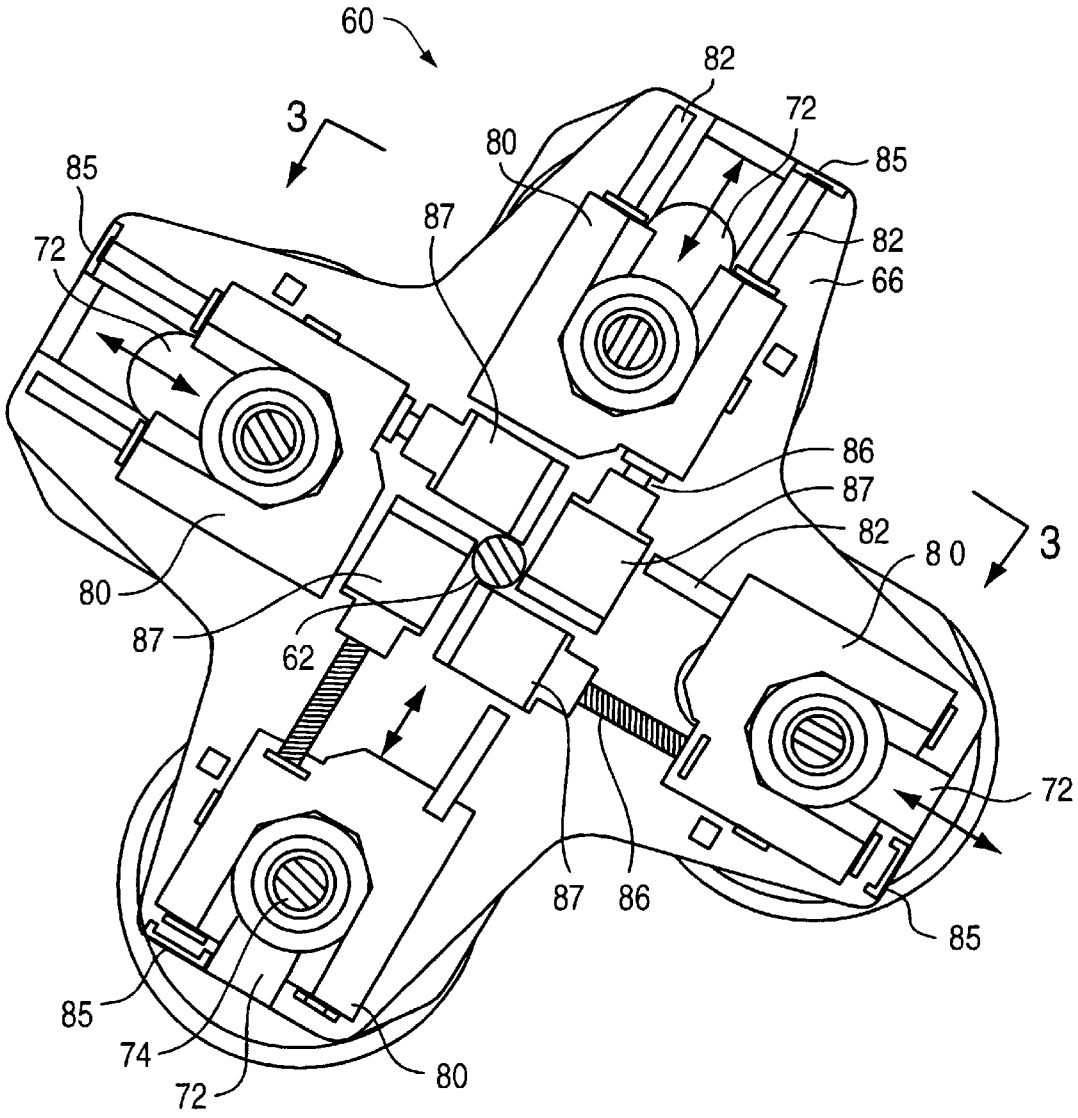
FIG. 2 is a schematic top view of a carousel, with the upper housing removed.

Referring to FIG. 2, in which cover 68 of carousel 60 has been removed, carousel support plate 66 supports the four carrier head systems 70*a*–70*d.* Carousel support plate includes four radial slots 72, generally extending radially and oriented 90° apart. Radial slots 72 may either be close-ended (as shown) or open-ended. The top of support plate supports four slotted carrier head support slides 80. Each slide 80 aligns along one of the radial slots 72 and moves freely along a radial path with respect to carousel support plate 66. Two linear bearing assemblies bracket each radial slot 72 to support each slide 80.

Figure 3:
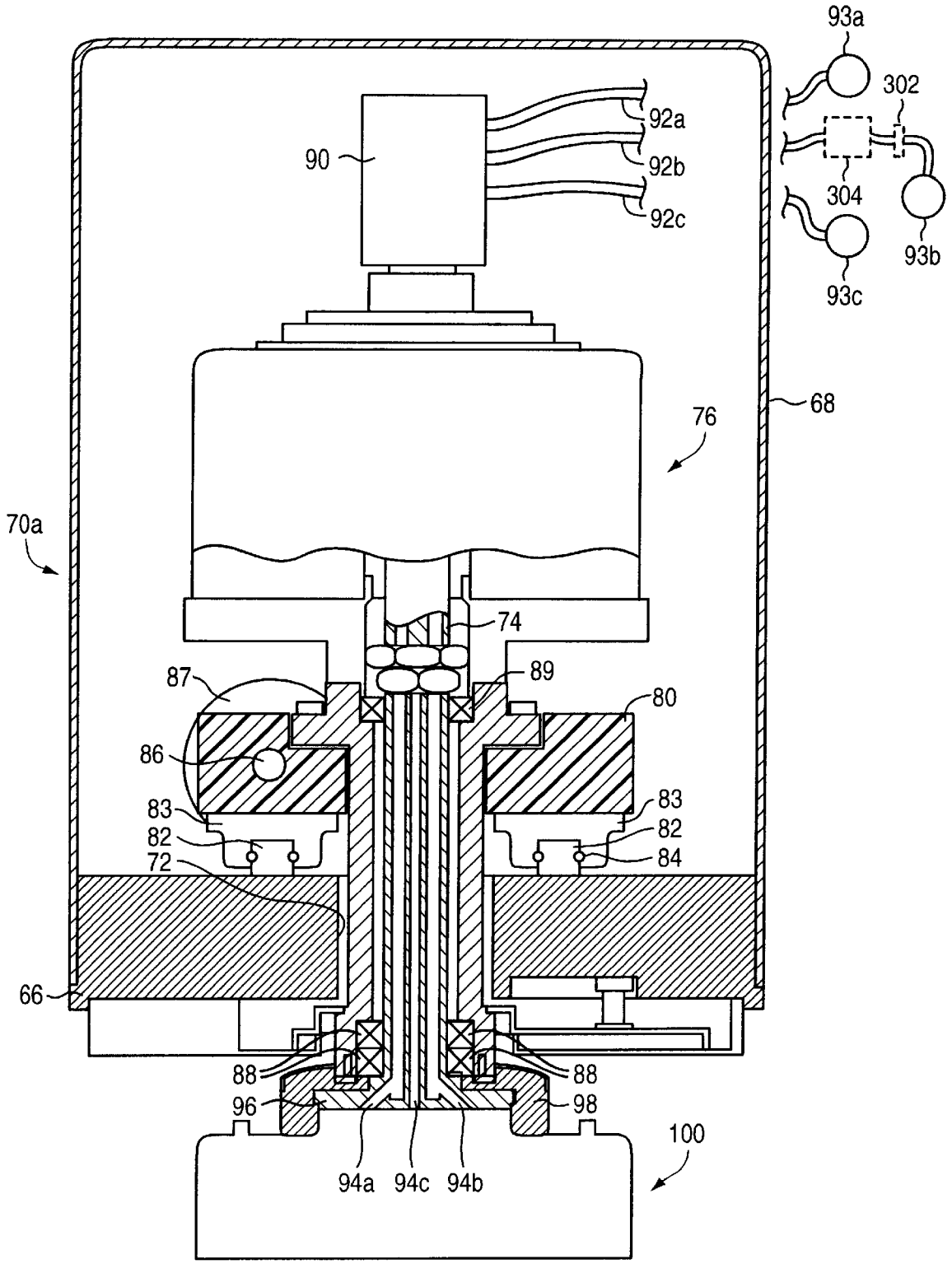
FIG. 3 is partially a cross-sectional view of the carousel of FIG. 2 along line 3—3, and partially a schematic diagram of the pumps used by the CMP apparatus.

As shown in FIGS. 2 and 3, each linear bearing assembly includes a rail 82 fixed to carousel support plate 66, and two hands 83 (only one of which is illustrated in FIG. 3) fixed to slide 80 to grasp the rail. Two bearings 84 separate each hand 83 from rail 82 to provide free and smooth movement therebetween. Thus, the linear bearing assemblies permit the slides 80 to move freely along radial slots 72.

A bearing stop 85 anchored to the outer end of one of the rails 82 prevents slide 80 from accidentally coming off the end of the rails. One of the arms of each slide 80 contains an unillustrated threaded receiving cavity or nut fixed to the slide near its distal end. The threaded cavity or nut receives a worm-gear lead screw 86 driven by a slide radial oscillator motor 87 mounted on carousel support plate 66. When motor 87 turns lead screw 86, slide 80 moves radially. The four motors 87 are independently operable to independently move the four slides along the radial slots 72 in carousel support plate 66.

A carrier head assembly or system, each including a carrier head 100, a carrier drive shaft 74, a carrier motor 76, and a surrounding non-rotating shaft housing 78, is fixed to each of the four slides. Drive shaft housing 78 holds drive shaft 74 by paired sets of lower ring bearings 88 and a set of upper ring bearings 89. Each carrier head assembly can be assembled away from polishing apparatus 20, slid in its untightened state into radial slot 72 in carousel support plate 66 and between the arms of slide 80, and there tightened to grasp the slide.

A rotary coupling 90 at the top of drive motor 186 couples two or more fluid or electrical lines 92*a*–92*c* into three or more channels 94*a*–94*c* in drive shaft 74. Three pumps 93*a*–93*c* may be connected to fluid lines 92*a*–92*c,* respectively. Channels 94*a*–94*c* and pumps 93*a*–93*c* are used, as described in more detail below, to pneumatically power carrier head 100 and to vacuum-chuck the substrate to the bottom of the carrier head. In the various embodiments of the carrier head described below, pumps 93*a*–93*c* remain coupled to the same fluid lines, although the function or purpose of the pumps may change.

During actual polishing, three of the carrier heads, e.g., those of carrier head systems 70*a*–70*c,* are positioned at and above respective polishing stations 25*a*–25*c*. Carrier head 100 lowers a substrate into contact with polishing pad 32, and slurry 50 acts as the media for chemical mechanical polishing of the substrate or wafer. The carrier head 100 uniformly loads the substrate against the polishing pad.

The substrate is typically subjected to multiple polishing steps, including a main polishing step and a final polishing step. For the main polishing step, usually performed at station 25*a,* carrier head 100 may apply a force of approximately four to ten pounds per square inch (psi) to substrate 10. At subsequent stations, carrier head 100 may apply more or less force. For example, for a final polishing step, usually performed at station 25*c,* carrier head 100 may apply a force of about three psi. Carrier motor 76 rotates carrier head 100 at about thirty to two-hundred revolutions per minute. Platen 30 and carrier head 100 may rotate at substantially the same rate.

Generally, carrier head 100 holds the substrate against the polishing pad and evenly distributes a downward pressure across the back surface of the substrate. The carrier head also transfers torque from the drive shaft to the substrate and ensures that the substrate does not slip from beneath the carrier head during polishing.

Figures 4, 4A:
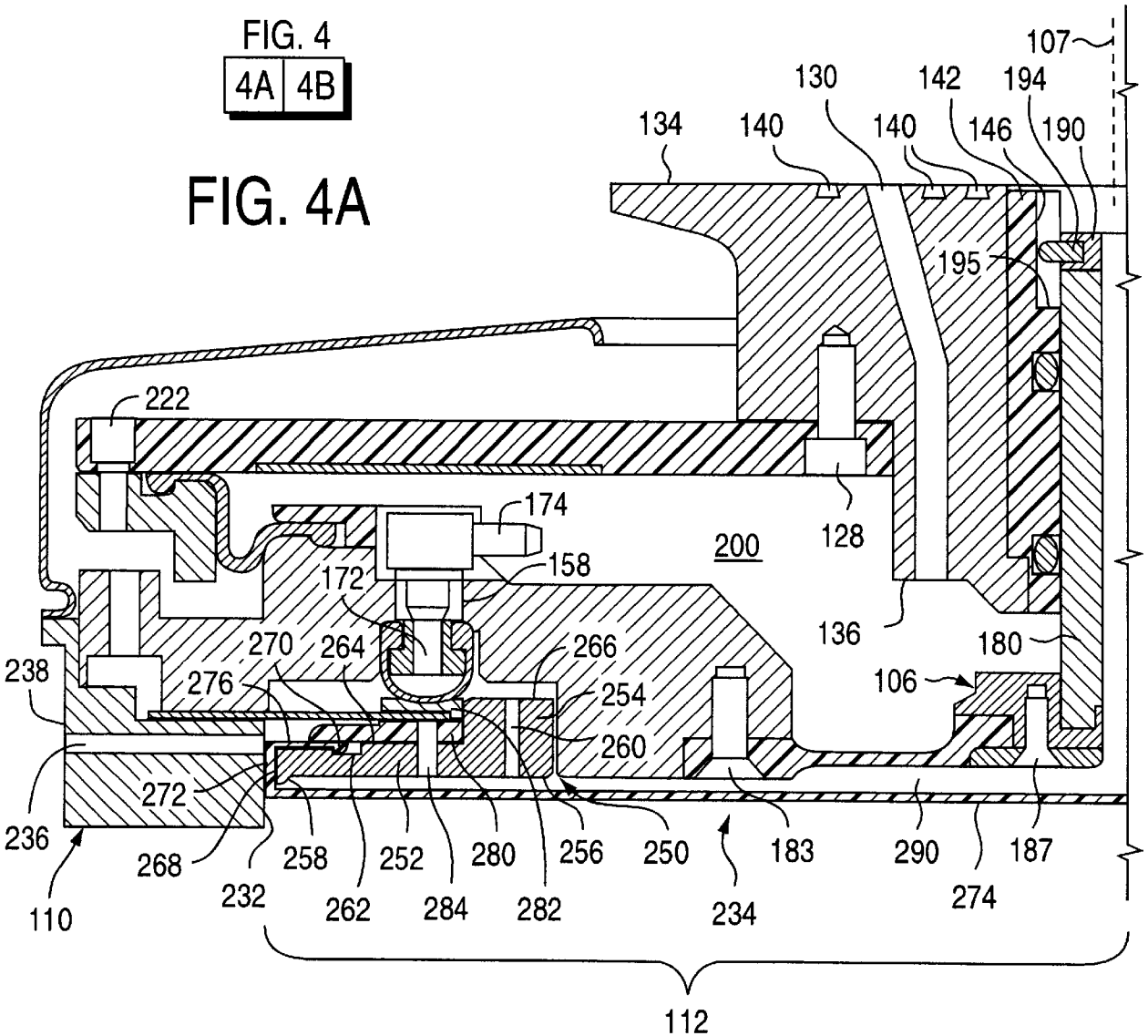
FIG. 4 is a schematic cross-sectional view of a carrier head in accordance with the present invention.
Figure 4B:
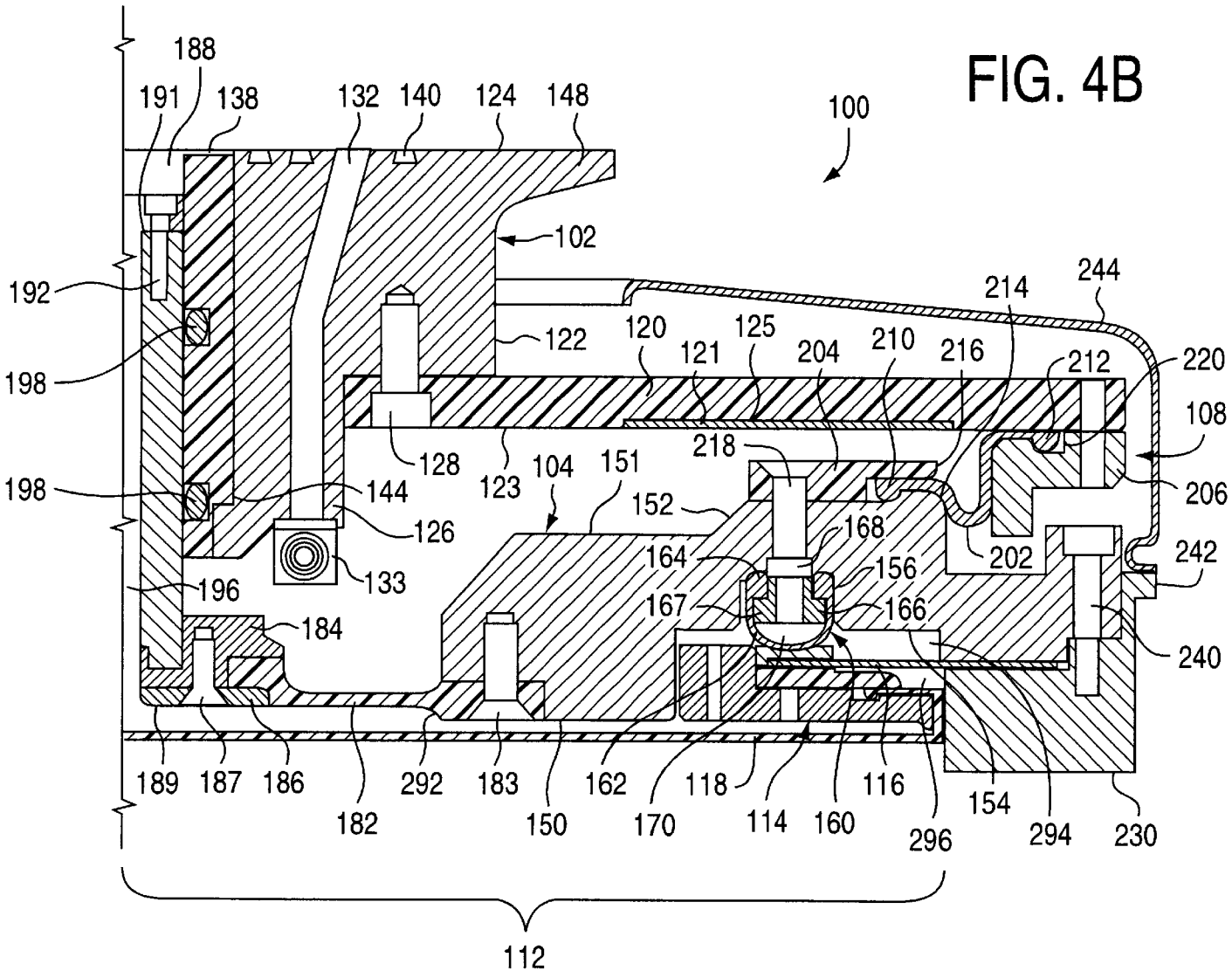
Figure 5:
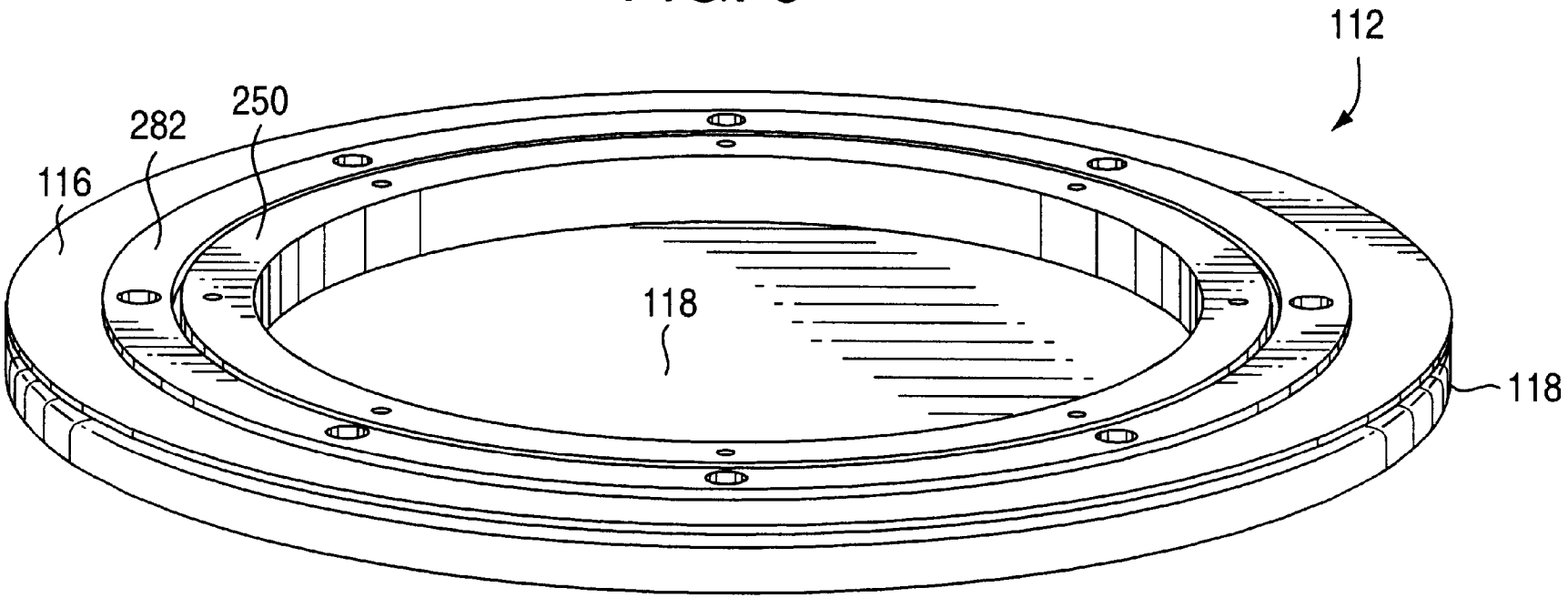
FIG. 5 is a cross-sectional view of the carrier head of FIG. 4 along line 5—5.
Figures 6, 6A:
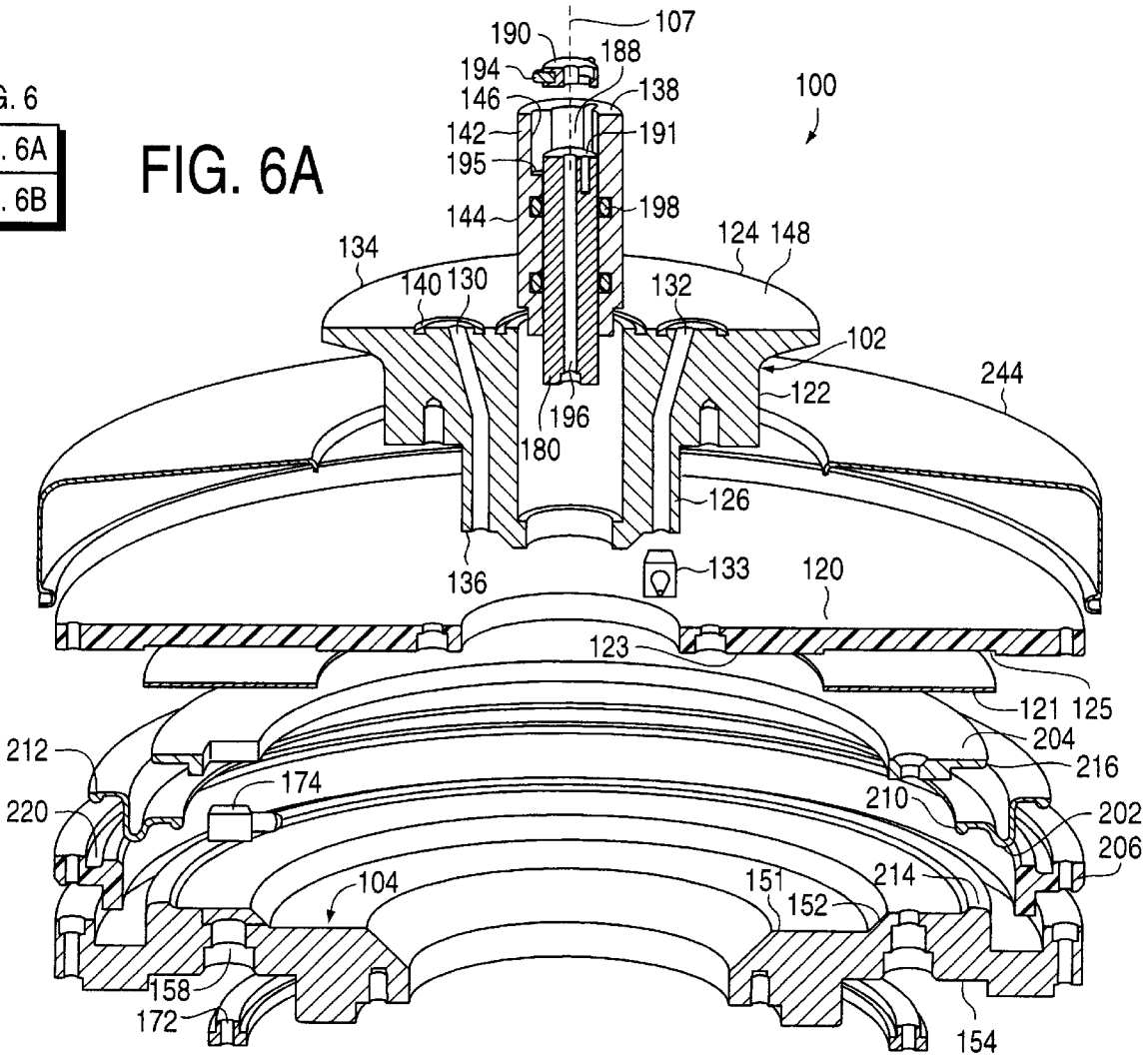
FIG. 6 is a schematic, exploded and partially cross-sectional perspective view of the carrier head of FIG. 4.
Figure 6B:
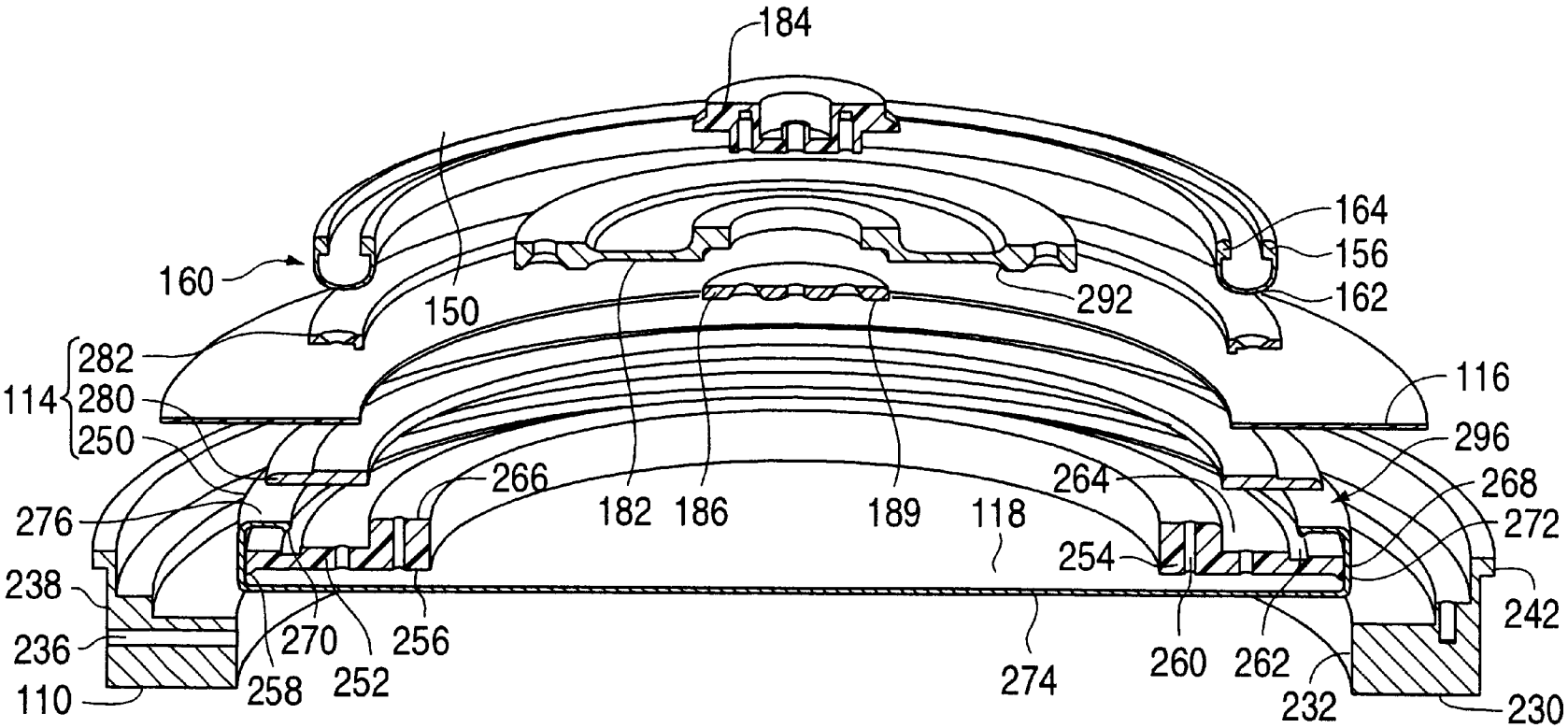

Referring to FIGS. 4–6, carrier head 100 includes a housing 102, a base 104, a gimbal mechanism 106, a loading mechanism 108, a retaining ring 110, and a substrate backing assembly 112. The housing 102 is connected to drive shaft 74 to rotate therewith about an axis of rotation 107 which is substantially perpendicular to the surface of the polishing pad. The loading mechanism 108 is positioned between housing 102 and base 104 to apply a load, i.e., a downward pressure, to base 104. The base 104 is fixed relative to polishing pad 32 by loading mechanism 108. Pressurization of a chamber 290 positioned between base 104 and substrate backing assembly 112 generates an upward force on the base and a downward force on the substrate backing assembly. The downward force on the substrate backing assembly presses the substrate against the polishing pad. The substrate backing assembly 112 includes a support structure 114, a flexure 116 connected between support structure 114 and base 104, and a flexible membrane 118 connected to support structure 114. The flexible membrane 118 extends below support structure 114 to provide a mounting surface 274 for the substrate. Each of these elements will be explained in greater detail below.

Housing 102 is generally circular in shape to correspond to the circular configuration of the substrate to be polished. The housing includes an annular housing plate 120 and a generally cylindrical housing hub 122. Housing hub 122 may include an upper hub portion 124 and a lower hub portion 126. The lower hub portion may have a smaller diameter than the upper hub portion. The housing plate 120 may surround lower hub portion 126 and be affixed to upper hub portion 122 by bolts 128. Both housing plate 120 and housing hub 122 may be formed of stainless steel or aluminum.

An annular cushion 121 may be attached, for example, by an adhesive, to a lower surface 123 of housing plate 120. Cushion 121 may fit into a recess 125 in the housing plate so that the cushion's bottom surface is flush with the lower surface of the housing plate. As discussed below, the cushion acts as a soft stop to limit the upward travel of base 104. Cushion 121 may be an open-cell pad, such as a fifty mil thick POLYTEX™ pad available from Rodel, Inc. of Newark, Del.

The housing hub 122 includes two passages 130 and 132 which connect an upper surface 134 of upper hub portion 124 to a lower surface 136 of lower hub portion 126. A fixture 133 for connecting a passage 132 to a flexible tube (not shown) in a fluid-tight manner may be mounted on lower surface 136 of lower hub portion 126. In addition, a central vertical bore 138 may extend along the central axis of the housing hub. O-rings 140 surround both passages 130 and 132, and central bore 138 to provide a fluid-tight seal when the carrier head is attached to the drive shaft. A cylindrical bushing 142 is press fit in central bore 138 and is supported by a ledge 144 formed in lower hub portion 126. Three slots 146 (only one of which is shown due to the cross-sectional view) are formed at equal angular intervals in the inner cylindrical surface of bushing 142. Bushing 142 may be a hard plastic material, such as a mixture of TEFLON™ and DELRIN™.

To connect housing 102 to drive shaft 74, carrier head 100 is then lifted so that two dowel pins (not shown) are fit into two dowel pin holes (not shown) in upper surface 134 of upper hub portion 124 and two paired dowel pin holes in drive shaft flange 96. This circumferentially aligns passages 130 and 132 with channels 94*a* and 94*b* (see FIG. 3). Central bore 138 will be aligned with central channel 94*c*. A flange 148 projects outwardly from upper hub portion 124 of housing 102. Flange 148 mates to flange 96 of drive shaft 74. A circular clamp (not shown) may clamp flange 148 to flange 96 to securely attach carrier head 100 to drive shaft 74.

Base 104 is a generally ring-shaped body located beneath the housing 102. The outer diameter of base 104 may be approximately the same as the outer diameter of housing plate 120, and the inner diameter of base 104 may be somewhat larger than the diameter of lower hub portion 126. A top surface 151 of the base includes an annular rim 152, and a lower surface 150 of base 104 includes an annular recess 154. An annular depression 156 may be formed in annular recess 152. The base 104 may be formed of a rigid material such as aluminum, stainless steel or a fiber-reinforced plastic.

A bladder 160 may be attached to a lower surface 150 of base 104. Bladder 160 may include a membrane 162 and a clamp ring 166. Membrane 162 may be a thin annular sheet of a flexible material, such as a silicon rubber, having protruding edges 164. The clamp ring 166 may be an annular body having a T-shaped cross-section and including wings 107. A plurality of holes, spaced at equal angular intervals, pass vertically through the clamp ring. As discussed below, one of these holes (on the left side of FIG. 4) may be used as a passage 172 for pneumatic control of bladder 160. The remainder of the holes may hold bolts to secure the clamp ring to the base. To assemble bladder 160, protruding edges 164 of membrane 162 are fit above wings 167 of clamp ring 166. The entire assembly is placed in annular depression 156. Clamp ring 166 may be secured to base 104 by screws 168 (only one screw is shown on the right hand side of this cross-sectional view because the other hole is used as passage 172). Clamp ring 166 seals membrane 162 to base 104 to define a volume 170. A vertical passage 172 extends through clamp ring 166 and is aligned with a vertical passage 158 in base 104. A fixture 174 may be inserted into passage 158, and a flexible tube (not shown) may connect fixture 133 to fixture 174.

Pump 93*b* (see FIG. 3) may be connected to bladder 160 via fluid line 92*b*, rotary coupling 90, channel 94*b* in drive shaft 74, passage 132 in housing 102, the flexible tube (not shown), passage 158 in base 104, and passage 172 in clamp ring 166. If pump 93*b* forces a fluid, preferably a gas, such as air, into volume 170, then bladder 160 will expand downwardly. On the other hand, if pump 93*b* evacuates fluid from volume 170, then bladder 160 will contract. As discussed below, bladder 160 may be used to apply a downward pressure to support structure 114 and flexible membrane 118.

Gimbal mechanism 106 permits base 104 to move with respect to housing 102 so that the base may remain substantially parallel with the surface of the polishing pad. Specifically, the gimbal mechanism permits the base to move vertically, i.e., along axis of rotation 107, and to pivot, i.e., to rotate about an axis parallel to the surface of the polishing pad, with respect to housing 102. However, gimbal mechanism 106 prevents base 104 from moving laterally, i.e., along an axis parallel to the polishing pad, with respect to the housing. Gimbal mechanism 106 is unloaded; that is, no downward pressure is applied from the housing through the gimbal mechanism to the base. However, the gimbal mechanism can transfer any side load, such as the shear force created by the friction between the substrate and polishing pad, to the housing.

Gimbal mechanism 106 includes a gimbal rod 180, a flexure ring 182, an upper clamp 184, and a lower clamp 186. The upper end of gimbal rod 180 fits into a passage 188 through cylindrical bushing 142. The lower end of gimbal rod 180 is attached to upper clamp 184. Alternatively, upper clamp 184 may be formed as an integral part of gimbal rod 180. The inner edge of flexure ring 162 is held between lower clamp 186 and upper clamp 184, whereas the outer edge of flexure ring 182 is secured to the lower surface 150 of base 104. Screws 187 may be used to secure lower clamp 186 to upper clamp 184, and screws 187 may be used to secure flexure ring 182 to base 104. Gimbal rod 180 may slide vertically along passage 188 so that base 104 may move vertically with respect to housing 102. However, gimbal rod 180 prevents any lateral motion of base 104 with respect to housing 102.

Gimbal rod 180, upper clamp 184 and lower clamp 186 are formed of rigid materials, such as stainless steel or aluminum. However, flexure ring 182, as its name implies, is formed of a moderately flexible material. The flexure ring material is selected to be able to withstand high strains, induced by pivoting of the base with respect to the housing, without breaking, and to have a moderate elastic modulus. The flexure ring 182 is sufficiently elastic that the carrier can undergo small pivoting motions without substantially changing the load distribution on the retaining ring. However, the flexure ring is sufficiently rigid that it effectively transmits the side load from the base to housing. The flexure ring is not as flexible as membrane 162 or membrane 118. Specifically, flexure ring 182 should be flexible enough to permit base 104 to pivot so that one edge of the base is approximately five to ten mils higher than the edge of the opposite base. The flexure ring may be formed of a hard plastic, such as DELRIN™, available from Dupont of Wilmington, Del. Alternately, the flexure ring may be formed of a laminate of glass fibers and epoxy resin, such as G10. Flexure ring 182 may bend slightly in the vertical direction, but is rigid in the radial direction.

A stop 190 is secured to a top surface 191 of the gimbal rod by three screws 192 (only one of which is shown due to the cross-sectional view). Three pins 194 (again, only one pin is shown) project horizontally from stop 190 and fit into the three slots 146 in bushing 142. Pins 194 are free to slide vertically, but not laterally, in slots 146. Thus, base 104 can move vertically relative to housing 102 without affecting the rotation of the carrier head. In addition, because gimbal rod 180 is free to slide in passage 188, pressure cannot be applied from housing 102 to base 104 through the gimbal mechanism. Stop 190 also limits the downward travel of base load 104 to prevent over-extension of the carrier head. Pins 194 will catch against the bottom ledge 195 of vertical slot 146 to halt the downward travel of the base.

Gimbal mechanism 106 may also include a vertical passage 196 formed along the central axis of the stop, the gimbal rod, the upper clamp, and the lower clamp. Passage 196 connects upper surface 134 of housing hub 122 to a lower surface of lower clamp 186. O-rings 198 may be set into recesses in bushing 142 to provide a seal between gimbal rod 180 and bushing 142.

The vertical position of base 104 relative to housing 102 is controlled by loading mechanism 108. The loading mechanism includes a chamber 200 located between housing 102 and base 104.

Chamber 200 is formed by sealing base 104 to housing 102. The seal includes a diaphragm 202, an inner clamp ring 204, and an outer clamp ring 206. Diaphragm 202, which may be formed of a sixty mil thick silicone sheet, is generally ring-shaped, with a flat middle section, a protruding inner edge 210 and a protruding outer edge 212. Inner edge 210 of diaphragm 202 rests on rim 152 of base 104, with inner edge 210 fitting over a ridge 214 which runs along the outer edge of rim 152.

Inner clamp ring 204 is used to seal diaphragm 202 to base 104. The inner clamp ring rests primarily on rim 152 and has an outer lip 216 which projects over ridge 214. Inner clamp ring 204 is secured to base 104, for example, by bolts 218, to firmly hold the inner edge of diaphragm 202 against base 104.

Outer clamp ring 206 is used to seal diaphragm 202 to housing 102. The protruding outer edge 212 of diaphragm 202 rests in a groove 220 on an upper surface of outer clamp ring 206. Outer clamp ring 206 is secured to housing plate 120, e.g., by bolts 222, to hold the outer edge of diaphragm 202 against the bottom surface of housing plate 120. Thus, the space between housing 102 and base 104 is sealed to form chamber 200.

Pump 93*a* (see FIG. 3) may be connected to chamber 200 via fluid line 92*a,* rotary coupling 90, channel 94*a* in drive shaft 74, and passage 130 in housing 102. Fluid, preferably a gas such as air, is pumped into and out of chamber 200 to control the load applied to base 104. If pump 93*a* pumps fluid into chamber 200, the volume of the chamber will increase and base 104 will be pushed downwardly. On the other hand, if pump 93*a* pumps fluid out of chamber 200, the volume of chamber 200 will decrease and base 104 will be pulled upwardly.

The optional cushion 121 may be positioned in housing plate 120 directly above inner clamp ring 204. Cushion 121 acts as a soft stop to halt the upward motion of base 104. Specifically, when chamber 200 is evacuated and base 104 moves upwardly, the inner clamp ring 204 abuts against cushion 121. This prevents any sudden jarring motions which might cause a vacuum-chucked substrate to detach from the carrier head.

When drive shaft 74 rotates housing 102, diaphragm 202 also rotates. Because diaphragm 202 is connected to base 104 by inner clamp ring 204, the base will rotate. In addition, because support structure 114 is connected to base 104 by flexure 116, the support structure and attached flexible membrane will also rotate.

Retaining ring 110 may be secured at the outer edge of the base 104. Retaining ring 110 is a generally annular ring having a substantially flat bottom surface 230. When fluid is pumped into chamber 200 and base 104 is pushed downwardly, retaining ring 110 is also pushed downwardly to apply a load to polishing pad 32. An inner surface 232 of retaining ring 110 defines, in conjunction with mounting surface 274 of flexible membrane 118, a substrate receiving recess 234. The retaining ring 110 prevents the substrate from escaping the receiving recess and transfers the lateral load from the wafer to the base.

Retaining ring 110 may be made of a hard plastic or a ceramic material. Retaining ring 110 may be secured to base 104 by, for example, bolts 240. In addition, retaining ring 110 may include one or more passages 236 connecting the inner surface 232 to an outer surface 238. As discussed below, passages 236 provide pressure equilibrium between the outside of the carrier head and a gap between the flexure and the support structure in order to ensure free vertical movement of the support structure.

Retaining ring 110 may also include an annular rim 242 which fits around the outer circumference of base 104. A shield 244 may be placed over carrier head 100 so that it rests on rim 242 of retaining ring 110 and extends over housing plate 120. Shield 244 protects the components in carrier head 100, such as diaphragm 202, from contamination by slurry 50.

The substrate backing assembly 112 is located below base 104. Substrate backing assembly 112 includes support structure 114, flexure 116 and flexible membrane 118. The flexible membrane 118 connects to and extends beneath support structure 114. In conjunction with base 104, support structure 114, flexure 116, and gimbal mechanics on 106, flexible membrane 118 defines a chamber 290. Support structure 114 and attached flexible membrane 118 are suspended from base 104 by flexure 116. The support structure 114 may fit into the space formed by annular recess 154 formed in base 104 and retaining ring 110.

Support structure 114 includes a support ring 250, an annular lower clamp 280, and an annular upper clamp 282. Support ring 250 is a rigid member which may have an annular outer portion 252 and a thicker annular inner portion 254. Support ring 250 may have a generally planar lower surface 256 with a downwardly-projecting lip 258 at its outer edge. One or more passages 260 may extend vertically through inner portion 254 of support ring 250 connecting lower surface 256 to an upper surface 266 of the inner portion. An annular groove 262 may be formed in an upper surface 264 of outer portion 252 of the support ring. Support ring 250 may be formed of aluminum or stainless steel.

Flexible membrane 118 is a circular sheet formed of a flexible and elastic material, such as a high-strength silicone rubber. Membrane 118 may have a protruding outer edge 270. A portion 272 of membrane 118 extends around a lower corner of support ring 250 at lip 258, upwardly around an outer surface 268 of outer portion 252, and inwardly along an upper surface 264 of outer portion 252. Protruding edge 270 of membrane 118 may fit into groove 262. The edge of flexible membrane 118 is clamped between lower clamp 280 and support ring 250.

The flexure 116 is a generally planar annular ring. Flexure 116 is flexible in the vertical direction, and may be flexible or rigid in the radial and tangential directions. The material of flexure 116 is selected to have a durometer measurement between 30 on the Shore A scale and 70 on the Shore D scale. The material of flexure 116 may be a rubber such as neoprene, an elastomeric-coated fabric such as NYLON™ or NOMEX™, a plastic, or a composite material such as fiberglass. Flexure 116 should be somewhat more flexible than the flexure ring 182, but may be approximately as flexible as flexible membrane 118. Specifically, flexure 116 should allow support structure 114 to move vertically by about one-tenth of an inch. The outer edge of flexure 116 is secured between lower surface 150 of base 104 and retaining ring 110. The inner edge of flexure 116 is secured between lower clamp 280 and upper clamp 282. Flexure 116 projects inwardly from its attachment point into recess 154. Annular upper clamp 282, annular lower clamp 280 and support ring 250 may be secured together by screws 284 to assemble support structure 114.

The space between flexible membrane 118, support structure 114, flexure 116, base 104, and gimbal mechanism 106 defines chamber 290. Passage 196 through gimbal rod 180 connects chamber 290 to the upper surface of housing 102. Pump 93*c* (see FIG. 3) may be connected to chamber 290 via fluid line 92*c,* rotary coupling 90, channel 94*c* in drive shaft 74 and passage 196 in gimbal rod 180. If pump 93*c* forces a fluid, preferably a gas such as air, into chamber 290, then the volume of the chamber will increase and flexible membrane 118 will be forced downwardly. On the other hand, if pump 93*c* evacuates air from fluid chamber 290, then the volume of the chamber will decrease and the membrane will be forced upwardly. It is preferred to use a gas rather than a liquid because a gas is more compressible.

The lower surface of flexible membrane 118 provides a mounting surface 274. During polishing, substrate 10 is positioned in substrate receiving recess 234 with the backside of the substrate positioned against the mounting surface. The edge of the substrate may contact the raised lip 258 of support ring 114 through flexible membrane 118.

By pumping fluid out of chamber 290, the center of flexible membrane 118 may be bowed inwardly and pulled above lip 258. If a substrate is positioned against mounting surface 274, the upward deflection of flexible membrane 118 will create a low pressure pocket between the membrane and the substrate. This low pressure pocket will vacuum-chuck the substrate to the carrier head.

Carrier head 100 provides independently controllable loads to the substrate and the retaining ring. The downward pressure of flexible membrane 118 against substrate 10 is controlled by the pressure in chamber 290. The downward pressure of retaining ring 110 against polishing pad 32 is controlled by both the pressure in chamber 200 and the pressure in chamber 290. Specifically, the load on retaining ring 110 is equal to the pressure in chamber 290 subtracted from the pressure in chamber 200. If the pressure in chamber 290 is greater than the pressure in chamber 200, no load will be applied to retaining ring 110. The independently controllable loads permit optimization of the retaining ring load in order to minimize the edge effect, as described in U.S. patent application Ser. No. 08/667,221, filed Jun. 19, 1996, by Guthrie, et al., entitled METHOD AND APPARATUS FOR USING A RETAINING RING TO CONTROL THE EDGE EFFECT, and assigned to the assignee of the present invention, the entire disclosure of which is hereby incorporated by reference.

Flexure 116 improves the uniformity of the load applied by flexible membrane 118 to substrate 10. Specifically, because support structure 114 may pivot and move vertically relative to base 104 and housing 102, the support structure may remain substantially parallel to the surface of the polishing pad. Because flexible membrane 118 is connected to support structure 114, the flexible membrane will also remain substantially parallel to the surface of the polishing pad. Therefore, the flexible membrane may adjust to a tilted polishing pad without deforming the portion of the membrane near the edge of the substrate. Consequently, the load on the substrate will remain uniform even if the polishing pad is tilted with respect to the carrier head. Flexible membrane 118 may deform to match the backside of substrate 10. For example, if substrate 10 is warped, flexible membrane 118 will, in effect, conform to the contours of the warped substrate. Thus, the load on the substrate will remain uniform even if there are surface irregularities on the backside of the substrate.

In addition, the load to substrate 10 will remain substantially uniform even at differing pressures. Specifically, flexure 116 permits support structure 114 and flexible membrane 118 to move vertically relative to base 104. When fluid is pumped into chamber 290, flexure 116 will deflect downwardly, increasing the volume of the chamber. Because the flexible membrane moves with the support structure 114, this vertical motion does not deform the edge of the flexible membrane. Consequently, the corner of flexible membrane 118 at the lower edge of support ring 114 will apply substantially the same load as the remainder of the flexible membrane.

The flexure 116 prevents support structure 114 and flexible membrane 118 from rotating with respect to base 104. Flexure 116 transfers any torque load, such as the frictional force from the rotating polishing pad 32, to base 104, which, in turn, transfers the load to housing 102 through gimbal mechanism 106. As base 104 rotates, flexure 116 also rotates, forcing support structure 114 and flexible membrane 118 to rotate thereby, causing substrate 10 to rotate with carrier drive shaft 74.

Furthermore, flexure 116, support structure 114 and flexible membrane 118 are configured and arranged so that the presence of flexure 116 does not create an additional downward pressure at the edge of the flexible membrane. From its attachment point at lower surface 150 of base 104, flexure 116 projects inwardly into annular recess 154. A part of structure 114 extends outwardly underneath flexure 116 beyond its attachment point to the flexure. Support structure 114 and flexure 116 are configured so that the surface area of lower surface 256 of support ring 250 is approximately equal to the total surface area of the upper surface 268 of support ring 250, annular upper clamp 282, and flexure 116. Since chamber 290 extends around both upper surface 258 and lower surface 256, the same pressure is applied by the chamber to the upper and lower surfaces. Thus, a downward pressure on the flexure plus the weight of the support structure is substantially balanced by an upward pressure on the support ring. The passages 260 through support ring 250 provide pressure equilibrium between a portion 294 of chamber 290 that is located above the support structure and the remainder of chamber 290.

There is a gap 296 between support structure 114 and the lower surface of flexure 116. Annular lower clamp 280 may be configured so that gap 296 has a wide portion, preferably near the outer edge of the support structure. For example, the lower clamp need not extend all the way to outer surface 268 of support ring 250. With this configuration, when chamber 290 is pressurized during polishing, flexure 116 may expand into the wide portion of gap 296 without contacting support structure 114. Since the free portion of the flexure does not contact the support structure, at least a portion of the downward pressure on the flexure is transferred to retaining ring 110 rather than support structure 114. This reduces the load on support structure 114 sufficiently so that, as discussed above, the downward pressure on the flexure plus the weight of the support structure is substantially balanced by an upward pressure on the support ring.

The passages 236 through retaining ring 110 can provide pressure equilibrium between gap 296 and the atmosphere outside of polishing head 100. This ensures that air can be vented from the gap so that support structure 114 is free to move vertically.

A carrier head of polishing apparatus 20 may operate as follows. Substrate 10 is loaded into substrate receiving recess 234 with the backside of the substrate abutting mounting surface 274 of flexible membrane 118. Pump **93*b* pumps fluid into bladder 160. This causes bladder 160 to expand and force support structure 114 downwardly. The downward motion of support structure 114 causes lip 258 to press the edge of flexible membrane 118 against the edge of substrate 10, creating a fluid-tight seal at the edge of the substrate. Then pump 93*c* evacuates chamber 290 to create a low-pressure pocket between flexible membrane 118 and the backside of substrate 10 as previously described. Finally, pump 93*a* pumps fluid out of chamber 200 to lift base 104, substrate backing assembly 112, and substrate 10 off a polishing pad or out of the transfer station. Carousel 60 then, for example, rotates the carrier head to a polishing station. Pump 93*a* then forces a fluid into chamber 200 to lower the substrate 10 onto the polishing pad. Pump 93*b* evacuates volume 170 so that bladder 160 no longer applies a downward pressure to support structure 114 and flexible membrane 118. Finally, pump 93*c* may pump a gas into chamber 290 to apply a downward load to substrate 10** for the polishing step.

In the alternate embodiments of the carrier head discussed below, elements with modified functions or operations will be referred to with primed reference numbers. Elements which are merely changed in size or shape will be referred to with unprimed reference numbers. For example, certain of the carrier heads discussed below are configured for polishing a six-inch (150 millimeters) diameter substrate. The changes to the size and shape of the elements to accommodate polishing of a six-inch substrate will not be discussed in detail, nor will elements changed for that purpose be referred to with primed reference numbers.

In addition, as discussed above, in the embodiments discussed below, although pumps 93*a*–93*c* remain coupled to fluid lines 92*a*–92*c*, respectively, the purpose or function of the pumps may change. In particular, the pumps may be connected to different pressure chambers in the different embodiments of the carrier head.

Figures 7, 7A:
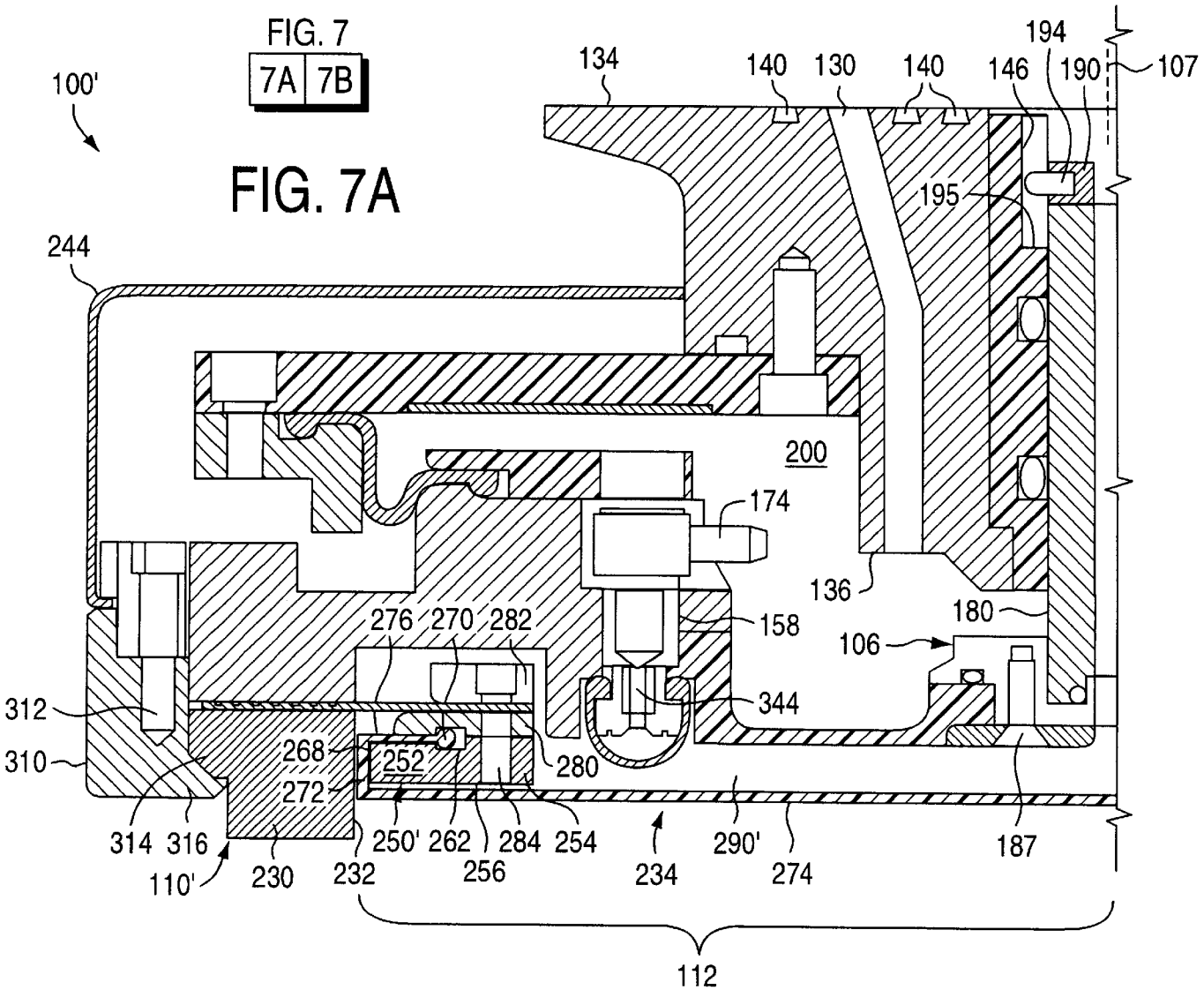
FIG. 7 is a schematic cross-sectional view of a carrier head in which a bladder is positioned to directly contact a flexible membrane.
Figure 7B:
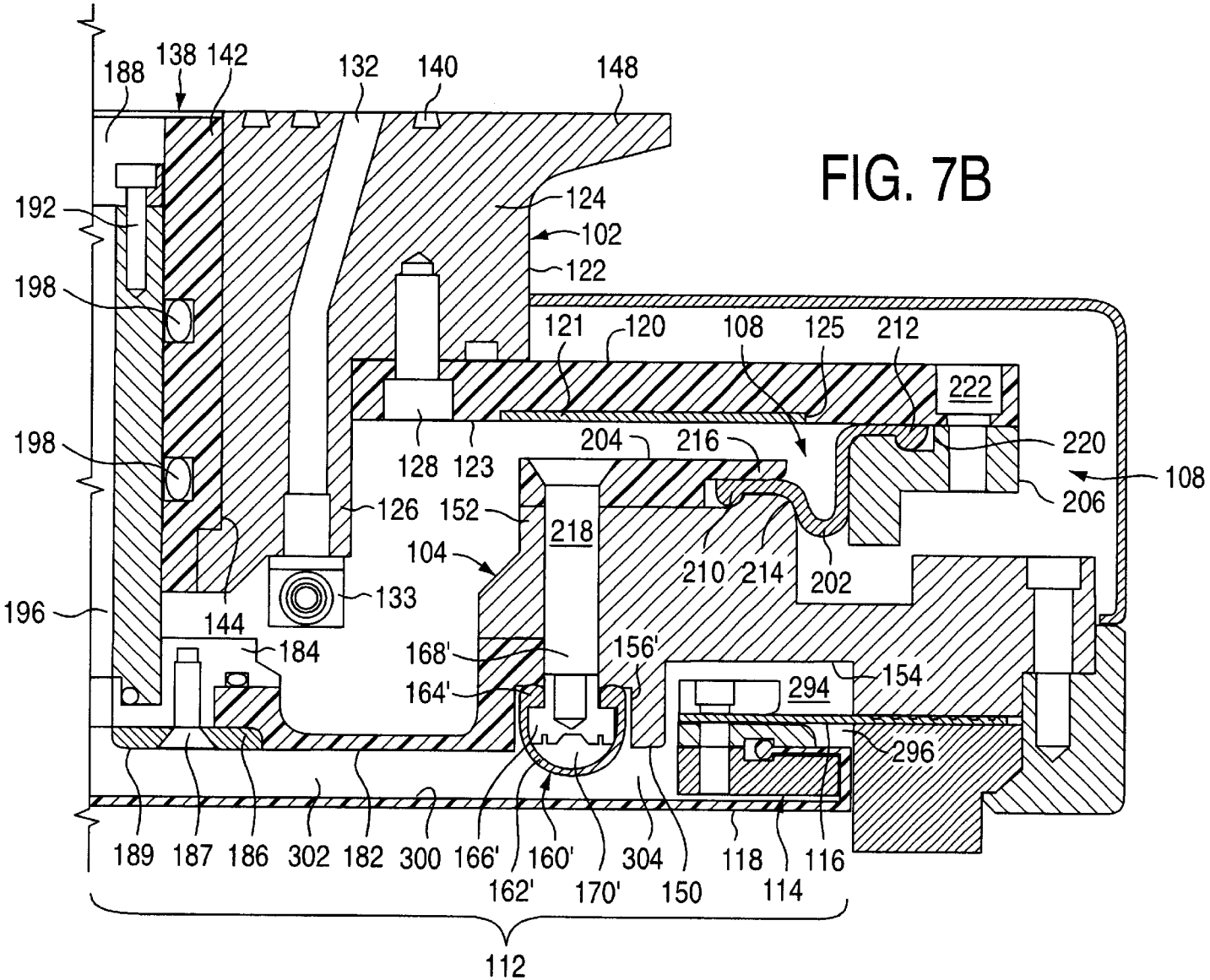

Referring to FIG. 7, in another embodiment, in which similar parts are referred to with primed reference numbers, bladder 160' is positioned beneath base 104 so that membrane 162' may directly contact an upper surface 300 of flexible membrane 118.

Carrier head 100' vacuum-chucks substrates in a fashion similar to that of the carrier head of FIG. 4. Specifically, substrate 10 is inserted into substrate receiving recess 234 with the backside of the substrate abutting mounting surface 274 of flexible membrane 118. Pump 93*b* pumps air into volume 170' to inflate bladder 160'. This causes membrane 162' to apply a downward pressure directly to an annular portion of upper surface 300 of flexible membrane 118'. This creates a fluid-tight seal between the flexible membrane and the substrate. Then pump 93*c* may evacuate fluid out of chamber 290 to create a low pressure pocket and vacuum-chuck the substrate to the carrier head.

There are several benefits of using bladder 160'. Bladder 160' provides a soft and deformable backing for flexible membrane 118'. Therefore when the chamber is evacuated and flexible membrane 118' is pulled inwardly to form the low-pressure pocket, the edge of the pocket will have a gentle slop. Because there is no hard edge to create stress on the substrate, the substrate is less likely to fracture during the chucking process. In addition, the depth of the suction cup is controllable. Once substrate 10 is chucked to the carrier head, bladder 160' may be inflated or deflated. If bladder 160' is inflated, membrane 118' and substrate 10 will be pushed downwardly, whereas if bladder 160' is deflated, membrane 118' and substrate 10 will be pulled upwardly.

One problem that has been encountered in chemical mechanical polishing is that the attachment of the substrate to the carrier head may fail, and the substrate may detach from the carrier head. If this occurs, the operator may not be able to visually observe that the carrier head no longer carries the substrate. In this situation, a CMP apparatus will continue to operate even though the substrate is no longer being polished. This wastes time and decreases throughput. In addition, a loose substrate, i.e. one not attached to a carrier head, may be knocked about by the moving components of the CMP apparatus, potentially damaging the CMP apparatus itself or leaving debris which may damage other substrates.

A CMP apparatus utilizing carrier head 100' may be operated to sense the presence of a substrate. If the CMP apparatus detects that the substrate is missing from the carrier head, the apparatus may alert the operator and automatically halt polishing operations to avoid wasted time and potential damage.

Referring to FIG. 3, apparatus 20 may include a valve 302 and a pressure gauge 304 placed in a fluid line 92*b* between rotary coupling 90 and pump 93*b*. Valve 302 and gauge 304 are shown in shadow because these elements are not used in conjunction with the embodiment of the carrier head previously described. When valve 302 is closed, volume 170' is sealed from pump 93*b* and pressure gauge 304 may measure the pressure in bladder 160'.

Returning to FIG. 7, apparatus 20 senses whether the carrier head successfully chucked the substrate as follows. The substrate is loaded into substrate receiving recess 234 so that the backside of the substrate contacts mounting surface 274. Pump 93*b* inflates bladder 160' to form a seal between flexible membrane 118 and substrate 10. Then valve 302 is closed to seal volume 170'. Pressure gauge 304 is used to measure the pressure in bladder 160. Then, pump 93*c* evacuates chamber 290' to create a low pressure pocket between the flexible membrane and the substrate. Finally, pump 93*a* evacuates chamber 200 to lift substrate 10 off of the polishing pad. Pressure gauge 304 then makes another measurement of the pressure in bladder 160' to determine whether the substrate was successfully vacuum-chucked to the carrier head.

On one hand, if the substrate is present, then the low pressure pocket created between the flexible membrane and the substrate will create an upward force on the substrate. This upward force will cause the substrate to press upwardly on membrane 162'. This will reduce the volume of bladder 160' and thereby increase the pressure in volume 170'. On the other hand, if a substrate is not present in the carrier head, then no upward force will be applied to the membrane and the pressure in volume 170' will remain constant. Therefore, if pressure gauge 304 measures a pressure increase concurrent with pump 93*c* pumping air out of chamber 290', the CMP apparatus has successfully vacuum-chucked the substrate to the carrier head. Pressure gauge 304 may also be used to continuously monitor the pressure within volume 170' to detect the presence of the substrate in the carrier head. If pressure gage 304 detects a decrease in the pressure of volume 170', e.g., while transporting the substrate between polishing stations or between a polishing station and a transfer station, then this is an indication that the substrate has detached from the carrier head. In this circumstance, operations may be halted and the CMP operator alerted of the problem.

Carrier head 100' also utilizes a different method to attach the retaining ring to the base. Retaining ring 110' may be secured to base 104 by a retaining piece 310. The retaining piece 310 may be secured to base 104 by screws 312. The retaining piece may catch in a projecting ledge 314 of retaining ring 110' with an annular lip 316.

Figures 8, 8A:
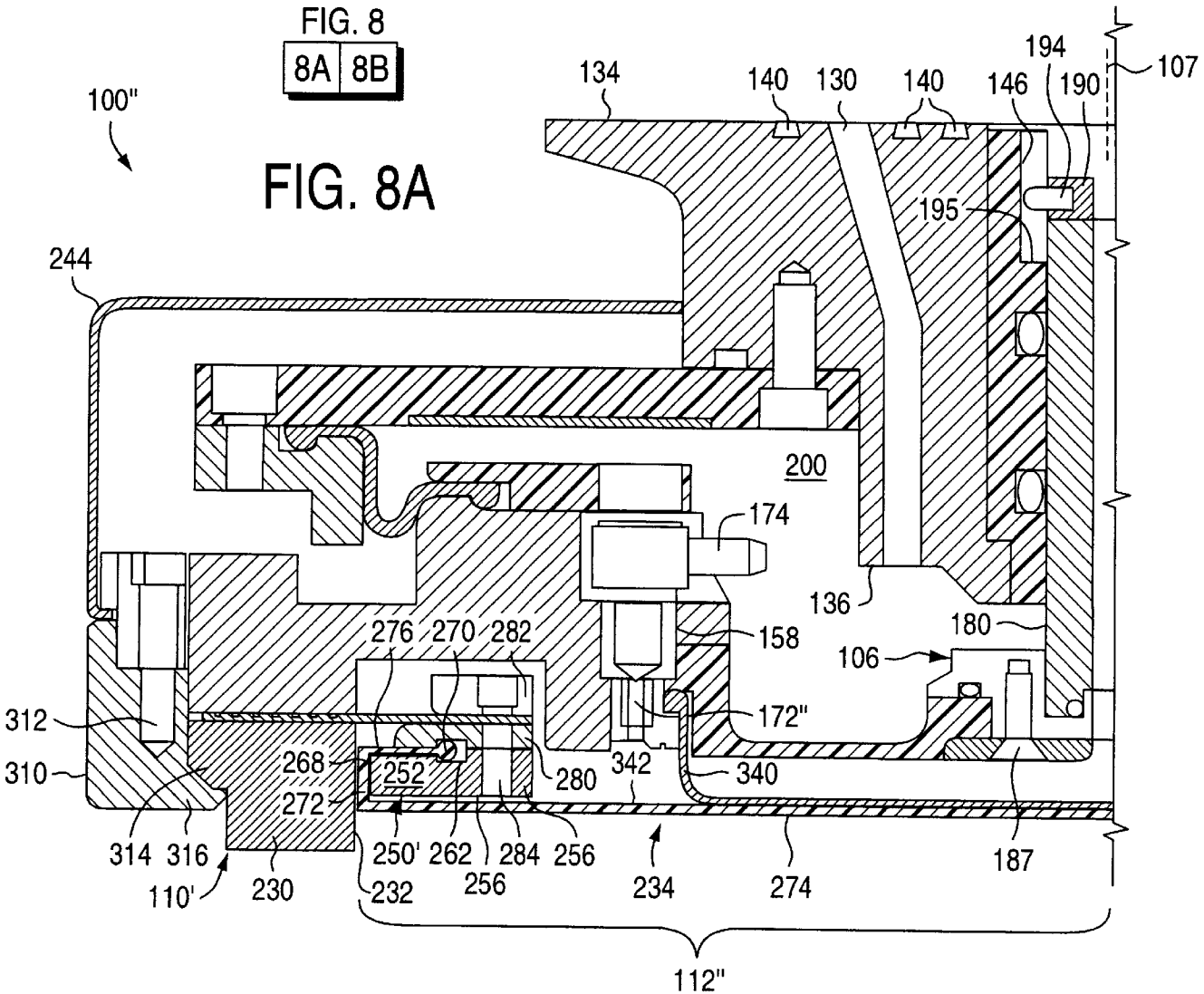
FIG. 8 is a schematic cross-sectional view of a carrier head which includes two chambers.
Figure 8B:
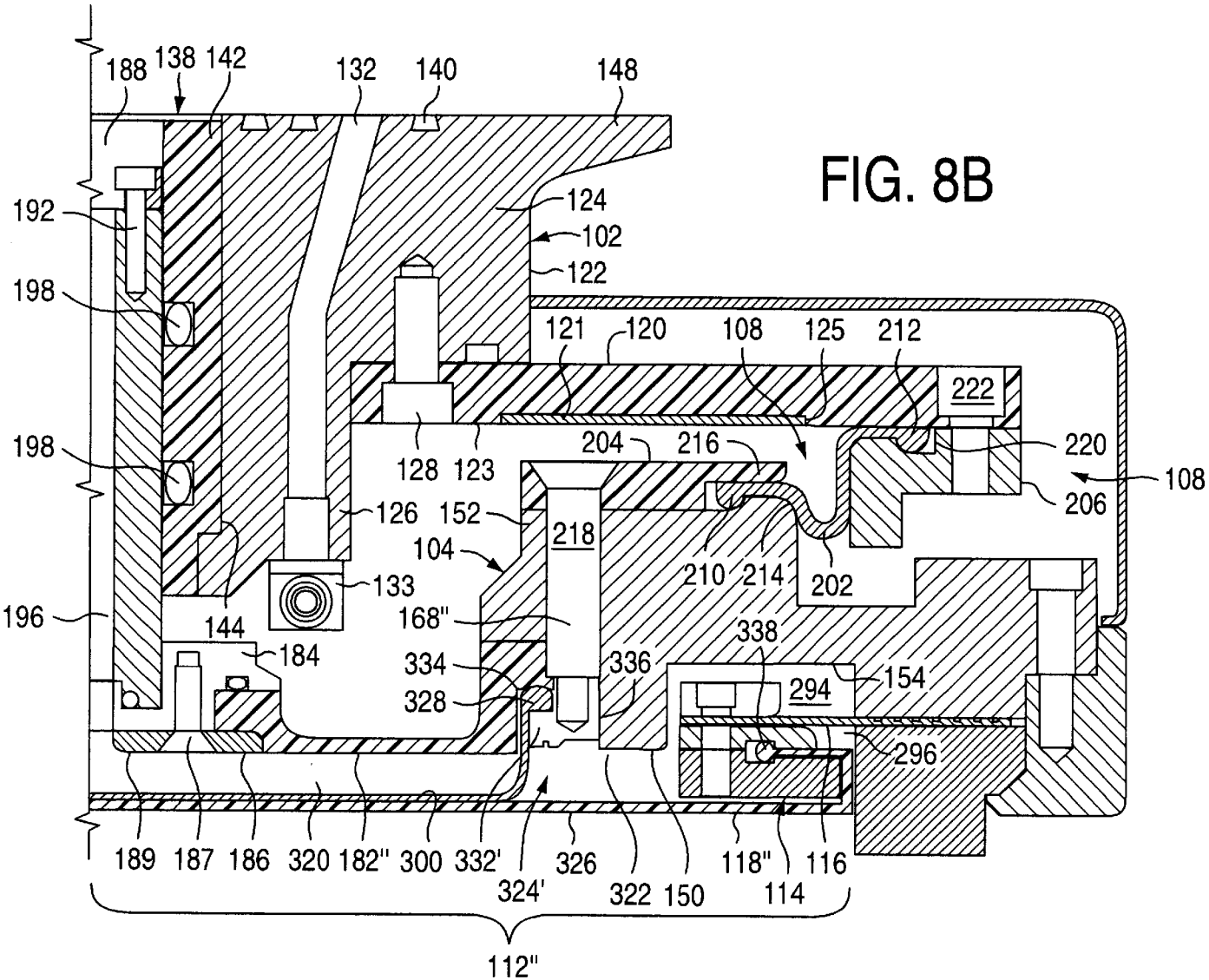

Referring to FIG. 8, in another embodiment, in which similar parts are referred to with double primed reference numbers, carrier head 100" includes a generally circular inner chamber 320 and a generally annular outer chamber 322 surrounding inner chamber 320.

In the carrier head of FIG. 8, substrate backing assembly 112" includes support structure 114, flexure 116, and flexible membrane 118'. The flexible membrane 118" may include an upper membrane or membrane portion 324 and a lower membrane or membrane portion 326. Lower membrane 326 is connected to support structure 114, whereas upper membrane 324 is connected directly to base 104. The upper membrane 324 defines inner chamber 320, whereas outer membrane 326 defines outer chamber 322. Flexible membrane 118" may be formed of a flexible and elastic material, such as a high strength silicone rubber.

Upper membrane 324 may be a circular sheet of a material, such as a high-strength silicone rubber. Inner membrane 324 may have a protruding outer edge 328. The outer edge 328 of upper membrane 324 may be captured between an annular wing 332 of an annular clamp ring 330 and a rim 334 on flexure ring 182". Clamp ring 330 may be secured in a recess 336 between flexure ring 182" and base 104 by bolts 168". The clamp ring presses the inner membrane against the flexure ring to form a fluid-tight seal. The space between upper membrane 324 and gimbal mechanism 106 defines generally circular upper chamber 320.

Lower membrane 326 may also be a circular sheet of material. Lower membrane 326 may have a protruding lower edge 338. The attachment of outer membrane 326 to support structure 114 is similar to the attachment of flexible membrane 118 to support structure 114 in FIG. 4. Specifically, outer edge 338 is secured in groove 262 and clamped between lower clamp 280 and support ring 250. The space between lower membrane 326, inner membrane 324, base 104, flexure 116, and support structure 114 defines generally annular outer chamber 322.

The portion of membrane 118" below chamber 320 provides a circular inner portion of the substrate mounting surface, whereas the portion of membrane 118" below chamber 322 provides an annular outer portion of the substrate mounting surface. A bottom surface 340 of inner membrane 324 may be attached, e.g., by an adhesive, to a top surface 342 of outer membrane 326. Alternately, upper membrane 324 and lower membrane 326 may be different portions of a single lower membrane.

Pump 93*c* may be connected to inner chamber 320 by fluid line 92*c,* rotary coupling 90, channel 94*c* in drive shaft 74, and passage 196 in gimbal mechanism 106. Similarly, pump 92*b* may be connected to outer chamber 322 by fluid line 92*b,* rotary coupling 90, channel 94*b* in drive shaft 74, passage 132 in housing 102, a flexible fluid connector (not shown), passage 158 in base 104, and a passage 344 in clamp ring 330.

Carrier head 100" may vacuum-chuck and sense the presence of substrate 10 in the carrier head in a fashion similar to that of the carrier head of FIG. 7. Specifically, during the vacuum-chucking process, pump 92*b* may pump fluid into outer chamber 322, causing the outer annular portion of membrane 118" to press directly against substrate 10 to form a fluid-tight seal. Then valve 302 (see FIG. 3) is closed and a first measurement of the pressure in outer chamber 322 is taken by gauge 304. Then pump 93*c* evacuates inner chamber 320 to create a low-pressure pocket to vacuum-chuck the substrate. If the substrate is successfully vacuum-chucked, the pressure measured by gauge 304 should increase.

Another problem that has been encountered in chemical mechanical polishing is that the edge of the substrate is often polished at a different rate (usually faster, but occasionally slower) than the center of the substrate. This may occur even if the load is uniformly applied to the substrate. To compensate for this effect, inner chamber 320 and outer chamber 322 may apply different loads to the substrate during polishing. For example, if the edge of the substrate is polishing more slowly than the center, the pressure within outer chamber 322 may be made greater than the pressure within inner chamber 320 thereby increasing polishing rate at the substrate edge. By selecting the relative loads, more uniform polishing of the substrate may be achieved.

The carrier head 100' of FIG. 7 may also be used to apply different loads to the edge and center of the substrate. To create a pressure differential between the center and edge of the substrate, bladder 160' begins in a deflated state and chamber 290 is pressurize to a desired pressure. Then bladder 160' is inflated so that membrane 162' contacts the upper surface 300 of flexible membrane 118. This effectively seals an annular outer portion of 304 of chamber 290 from a circular inner portion 302 of chamber 290. To increase the pressure on the center of the substrate vis-a-vis the edge, pump 93*c* may force fluid into circular inner portion 302. Because outer portion 304 is sealed by bladder 160', its pressure does not change. To decrease the pressure on the center of the substrate vis-a-vis the edge, pump 93*c* may evacuate inner portion 302 after bladder 160' forms the seal.

Since membrane 162' is not bonded or clamped to flexible membrane 118, the seal created by bladder 160' may not be completely fluid-tight. Therefore, fluid may gradually leak between the membranes until portions 302 and 304 have the same pressure. Thus, it may be necessary to periodically perform the procedure described above.

Figure 9A:
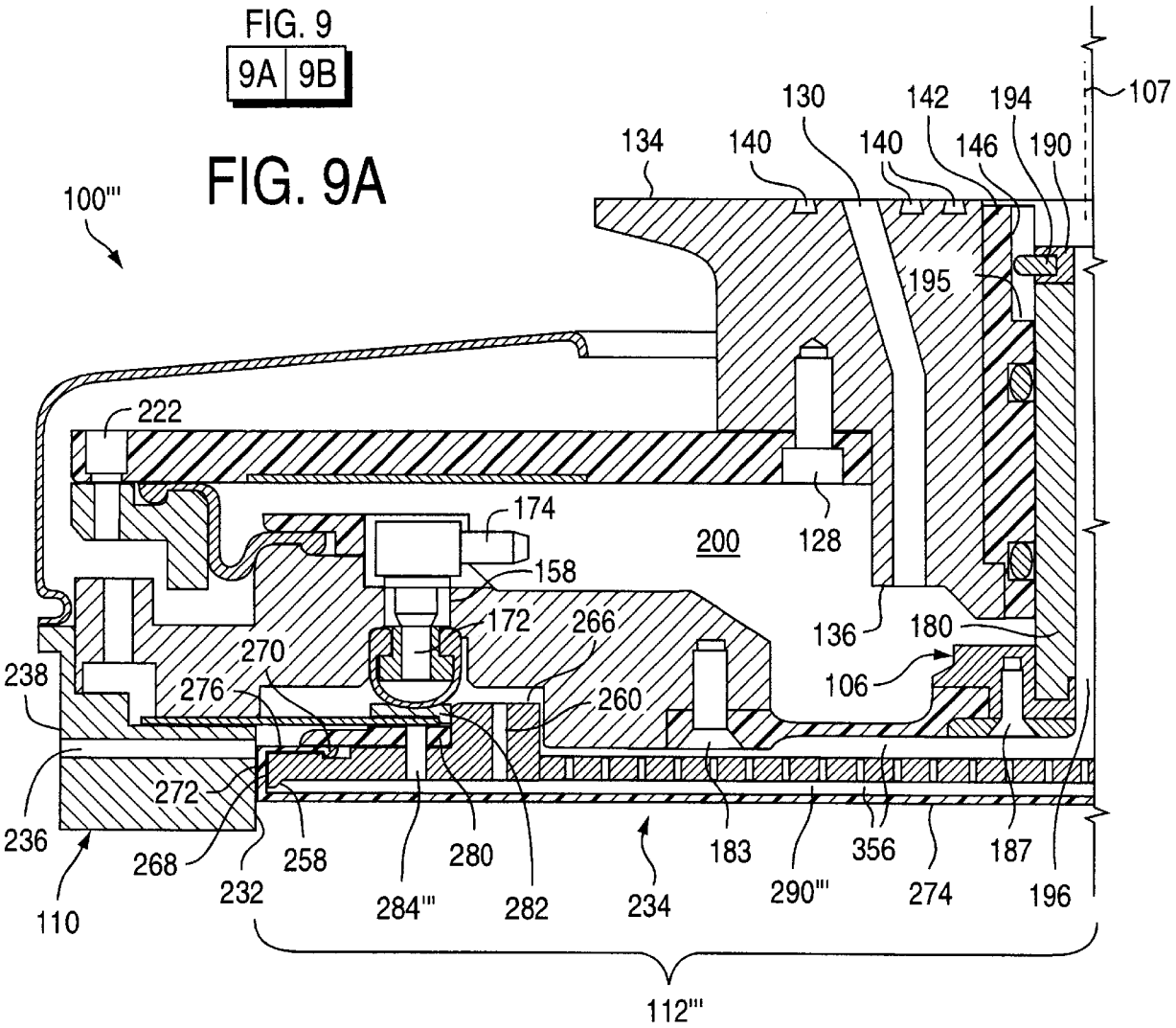
FIG. 9 is a schematic cross-sectional view of a carrier head in which a support plate is used in place of a support ring.
Figure 9B:
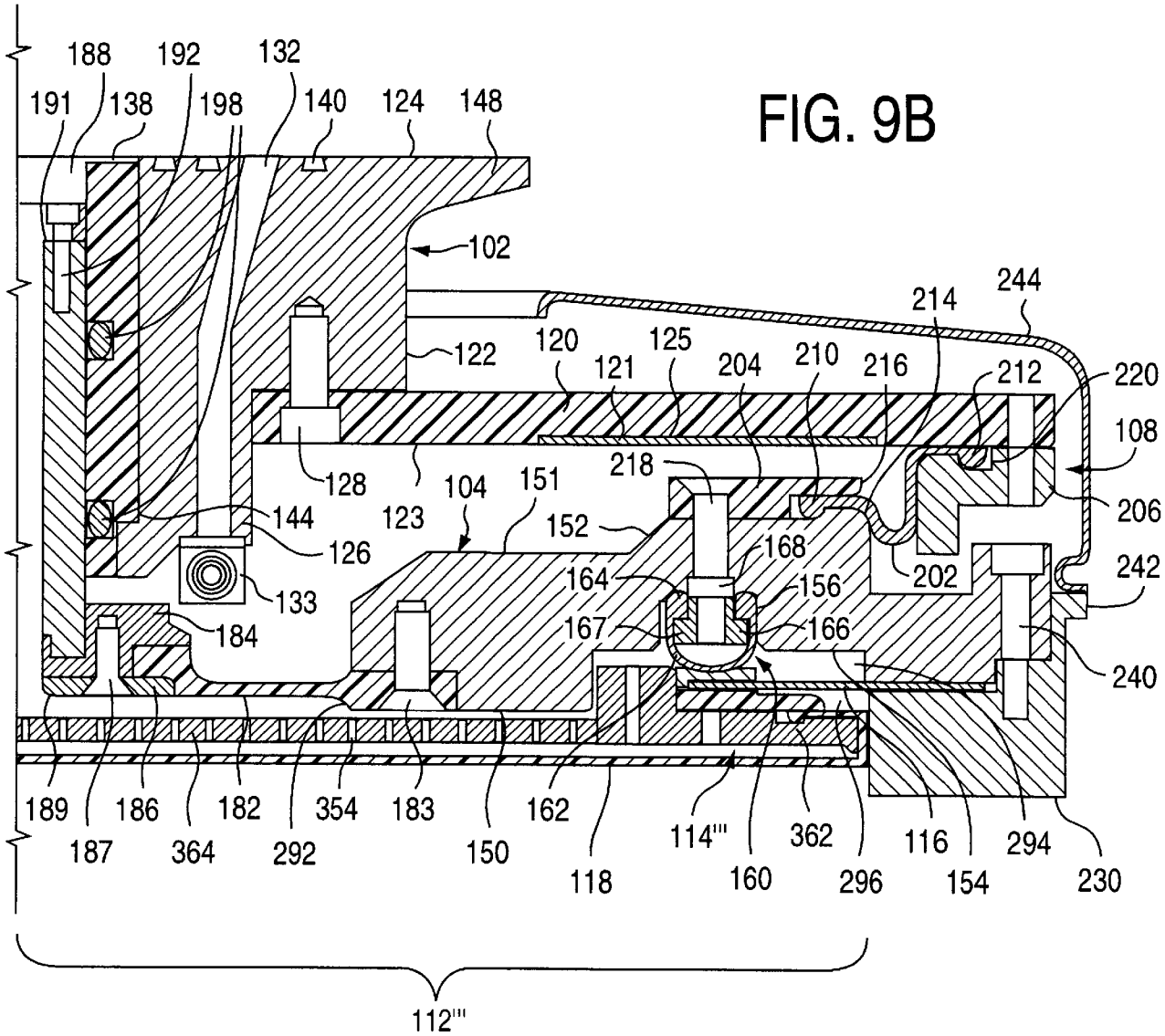

Referring to FIG. 9, in another embodiment, in which similar parts referred to with triple primed reference numbers, substrate backing assembly 112'" includes a support plate 350 rather than a support ring.

Support plate 350 is a generally disk-shaped body. As part of support structure 114'", the entire support plate may move vertically and pivot with respect to base 104. Annular lower clamp 280 and annular upper clamp 282 may be secured to an edge portion 362 of the support plate by bolts 284'".

Support plate 350 has a generally planar lower surface 352. Support plate 350 is suspended in chamber 290'" by flexure 116. A plurality of apertures 354 extend vertically through a center portion 364 of the support plate to connect lower surface 352 to an upper surface 360. Apertures 354 connect a portion 356 of chamber 290'" located above the support plate to a portion 358 of chamber 290'" located below the support plate. Alternately, lower surface 352 of support plate 350 may have a recessed region, with a single aperture connecting chamber portion 356 to chamber portion 358.

Figure 13:
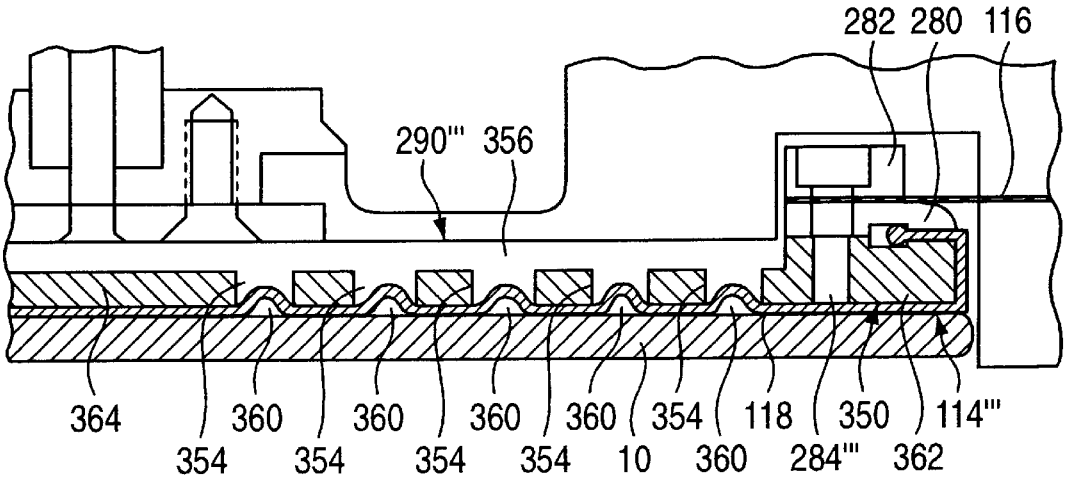
FIG. 13 is a schematic cross-sectional view of a carrier head illustrating the vacuum-chucking of a substrate.

Flexible membrane 118 is clamped between support plate 350 and lower clamp 280, and extends beneath the lower surface of the support plate. When pump 93*c* evacuates chamber 290'", flexible membrane 118 is pulled upwardly against support plate 350 and into apertures 354. If the backside of the substrate is placed against mounting surface 274, then the extension of the flexible membrane into the apertures creates a plurality of low-pressure pockets 360 between the substrate and the flexible membrane (see FIG. 13). These low-pressure pockets vacuum-chuck the substrate to the carrier head.

One problem encountered in the CMP process is difficulty in removing the substrate from the polishing pad. As previously discussed, a thin layer of slurry is supplied to the surface of the polishing pad. When the substrate contacts the polishing pad, the surface tension of the slurry generates an adhesive force which binds the substrate to the polishing pad. If this surface tension holding the substrate on the polishing pad is greater than the force holding the substrate on the carrier head, then when the carrier head retracts, the substrate will remain on the polishing pad.

Figure 12:
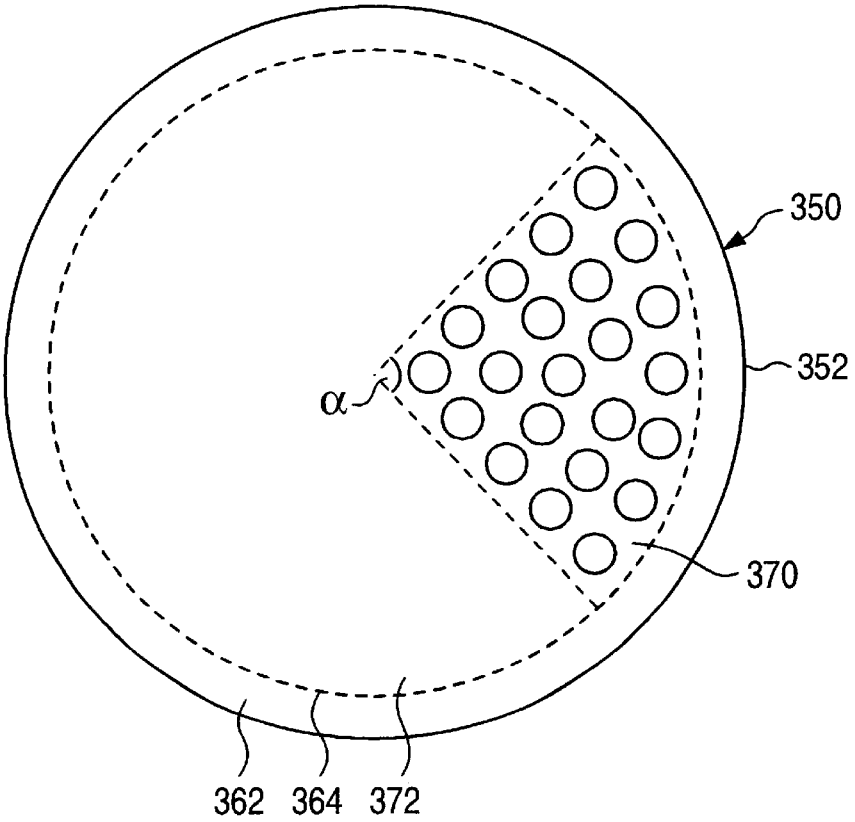
FIG. 12 is a bottom view of the support plate of the carrier head shown in FIG. 9.

One arrangement for reliably removing the substrate from the polishing pad is shown in FIG. 12. As shown in FIG. 12, the distribution of apertures 354 across lower surface 352 may be asymmetric rather than radially symmetric. That is, the support plate may include an area 370 with apertures and an area 372 without apertures. Area 370 may be generally wedge-shaped, with an angle $\alpha$ between 45° and 180°. Area 370 may also be located only near the edge of portion 364 of support plate 350, rather than extending to the center of the support plate.

During the vacuum-chucking of the substrate, the asymmetrical distribution of apertures 354 results in an asymmetrical application of an upward force to the substrate. The asymmetrical force creates a torque on the substrate which tends to preferentially lift one edge of the substrate away from the polishing pad. This reduces the adhesive force due to the slurry surface tension, and improves the reliability of vacuum-chucking the substrate to the carrier head.

Figures 14, 14A:
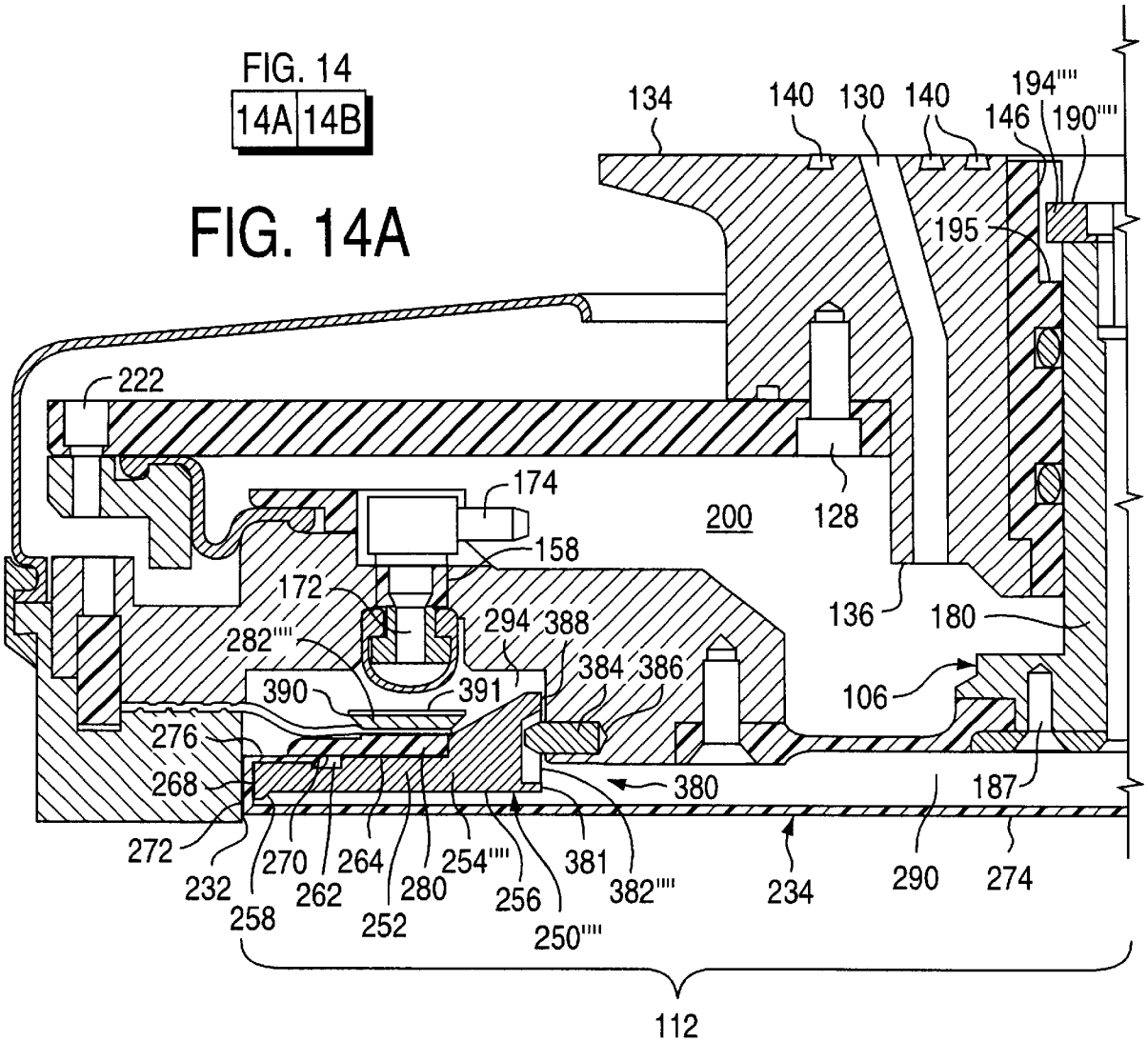
FIG. 14 is a schematic cross-sectional view of a carrier head including a stop-pin assembly.
Figure 14B:
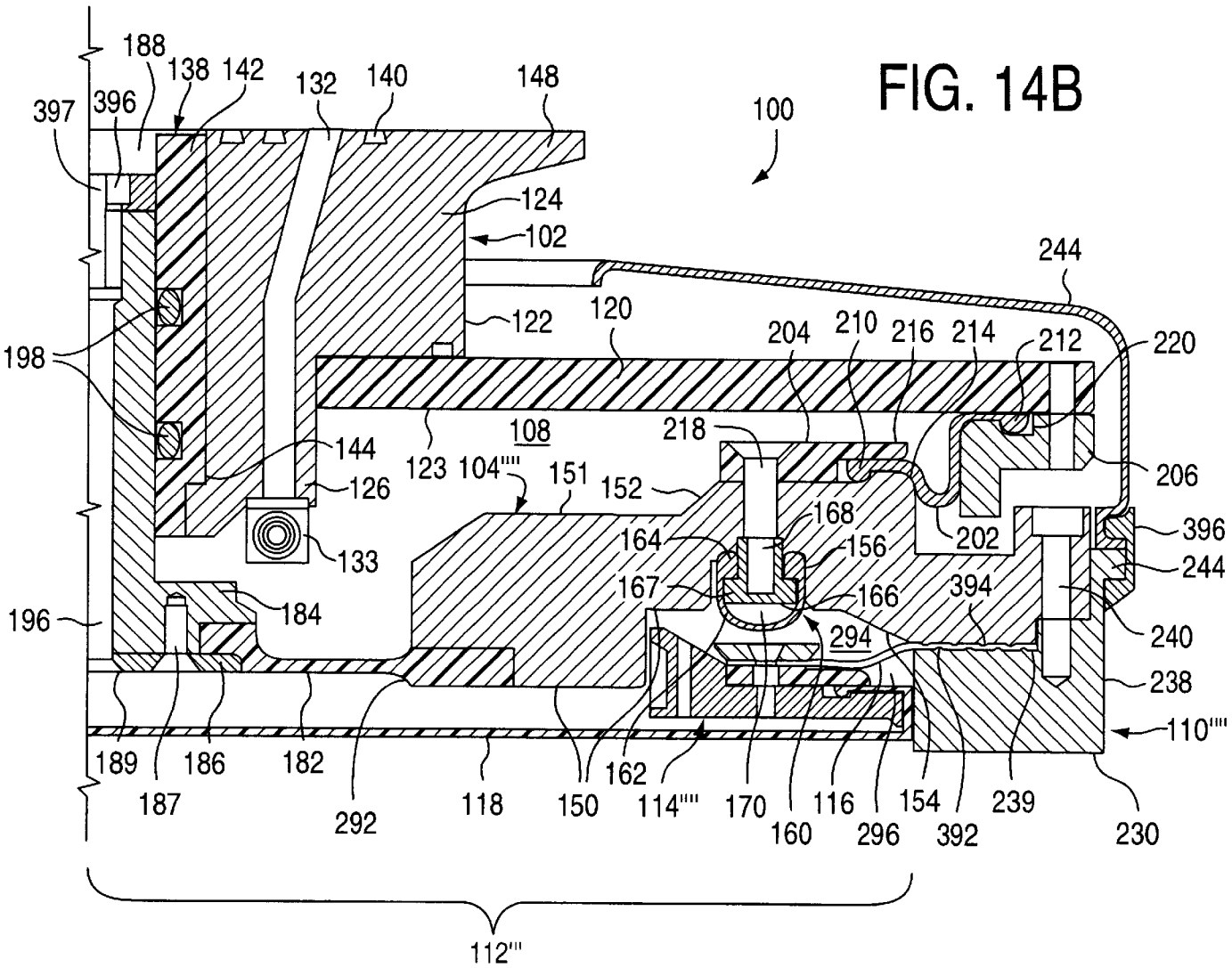

Referring to FIG. 14, in another embodiment, in which similar parts are referred to with quadruple primed reference numbers, the carrier head includes a stop pin assembly 380 to limit the downward motion of support structure 114''''.

In the carrier head of FIG. 14, inner portion 254'''' of support ring 250'''' has a generally wedged-shaped cross-section. An inner surface 381 of the wedged-shaped inner portion has an annular recess 382 formed therein. Three or more stop pins 384 (only one of which is shown due to the cross-sectional view), positioned at equal annular intervals, fit into holes 386 in base 104''''. The stop pins 384 project outward horizontally and into angular recess 382 in support ring 250''''. If fluid is pumped into chamber 290, thereby forcing support structure 114 downwardly, an upper rim 388 of support ring 250'''' may catch against stop pins 384 to limit the downward travel of the support structure.

The annular upper clamp 282'''' includes one or more radial grooves 390 (only one is shown) in upper surface 391. When bladder 160 is inflated and membrane 162 contacts annular upper clamp 282'''', radial grooves 390 form channels between the portions of volume 294 of chamber 290 located on either side of bladder. The separation of volume 294 into two separate portions is not shown in FIG. 14 (because the substrate backing assembly 112 is shown in a lowered position for polishing), but can be seen in FIG. 4. These channels permit pressure equilibrium to ensure uniform polishing.

An upper surface 239 of retaining ring 110'' may have a series of concentric circular ridges 392. An outer annular area of lower surface 150 of base 104'''' may also include a series of concentric circular ridges 394. When the carrier head is assembled, with retaining ring 110'''' attached to base 104'''', ridges 392 will mate to ridges 394 and pinch the outer circumferential portion of flexure 116 therebetween. This provides an improved clamp which prevents the flexure from slipping.

The gimbal mechanism may include a Y-shaped stop 190'''' with three arms 194''''. Stop 190'''' may be connected to top surface 191 of gimbal rod 180 with a single central bolt 396. The central bolt 396 may have a vertical passage 397 therethrough to provide a fluid connection between upper surface 134 of housing 102 and passage 196 in gimbal rod 180.

An annular seal 396 with a C-shaped cross section may be used to hold shield 244 on rim 242 of retaining ring 110''''.

Figures 10, 10A:
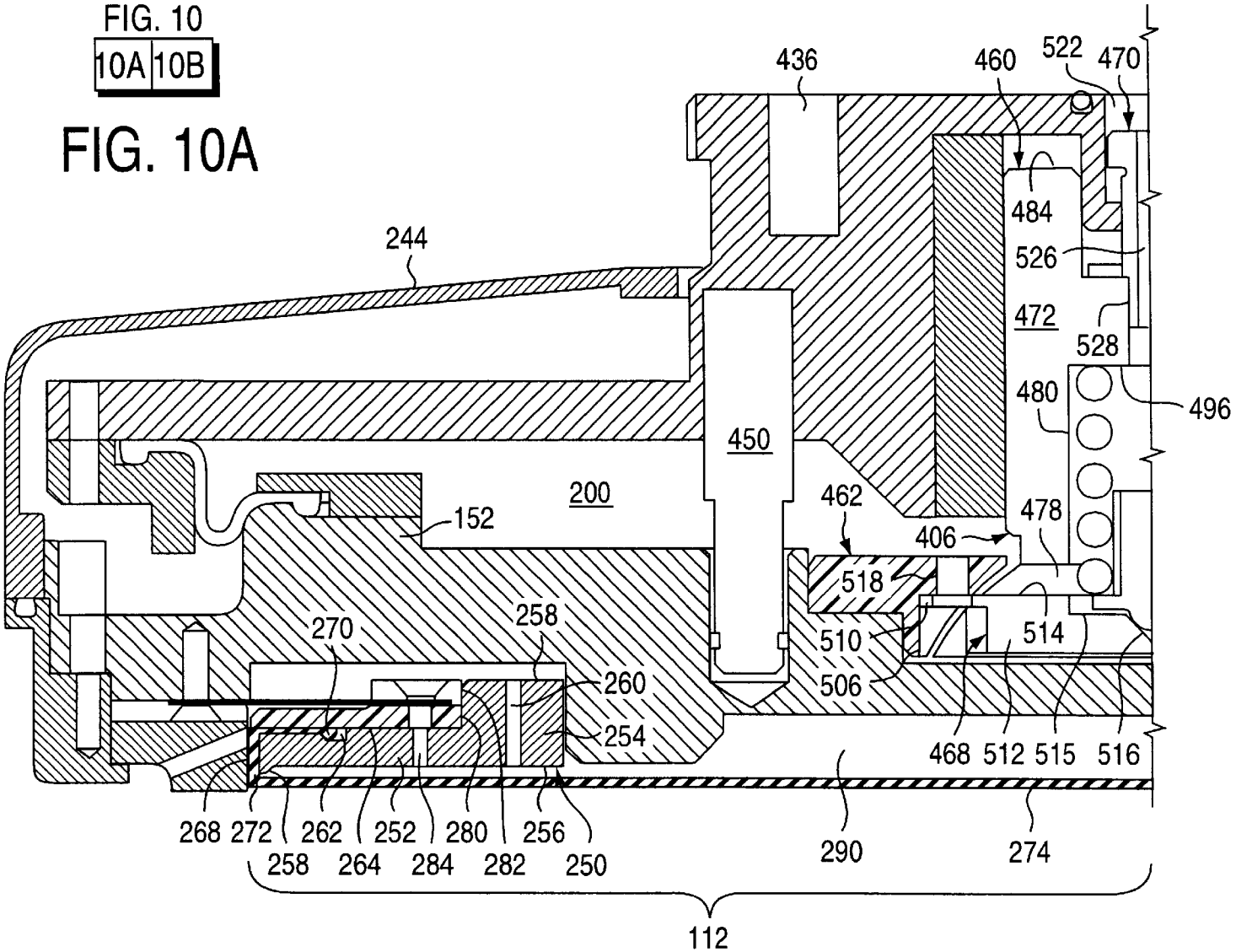
FIG. 10 is a schematic cross-sectional view of a carrier head illustrating a gimbal mechanism including a gimbal body and a gimbal race.
Figure 10B:
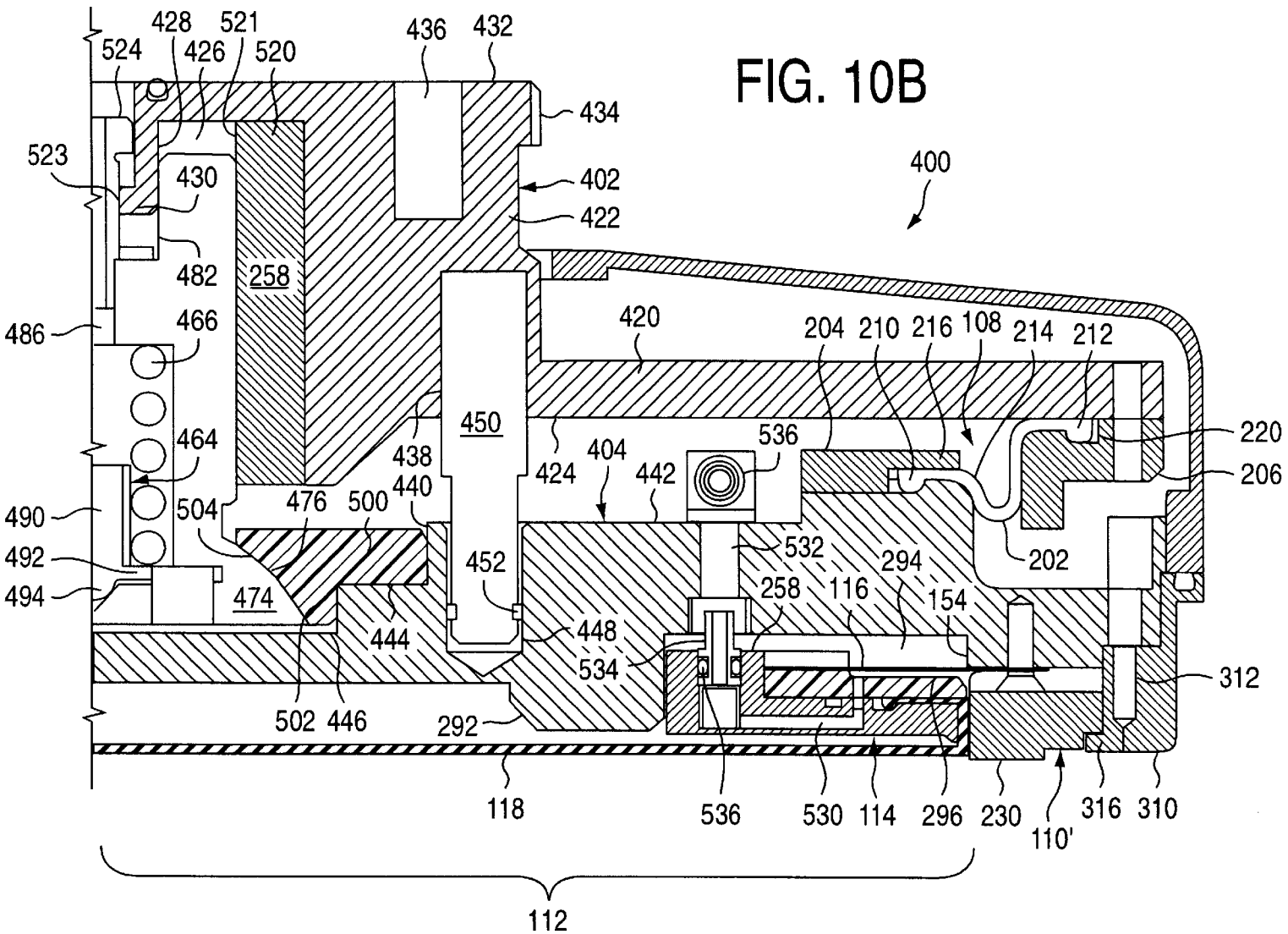
Figure 11:
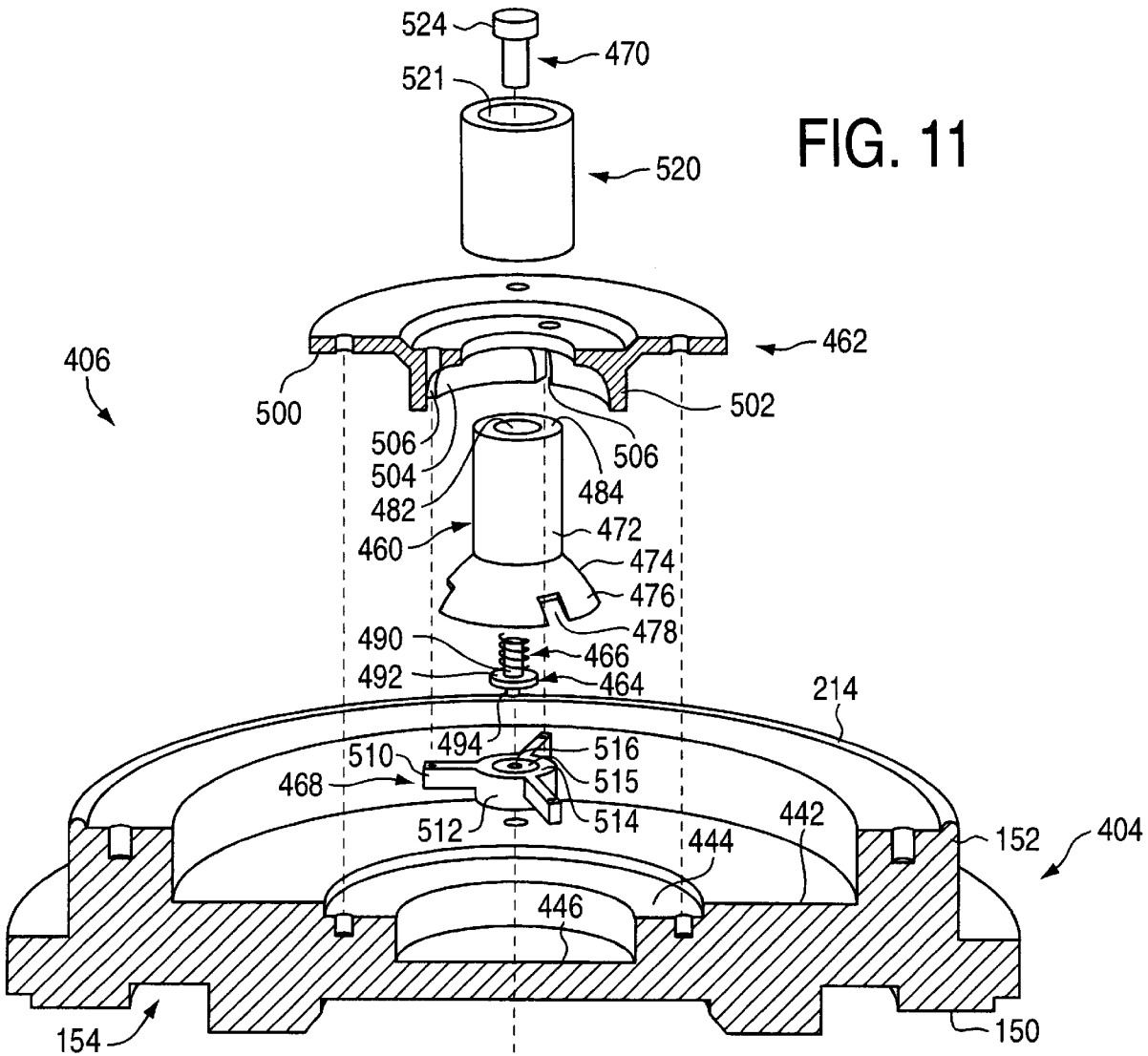
FIG. 11 is an exploded and partially cross-sectional perspective view of the gimbal mechanism of FIG. 10.

Referring to FIGS. 10 and 11, in another embodiment, a carrier head 400 includes a gimbal mechanism 406 which includes a gimbal body 460 and a gimbal race 462 rather than a flexure ring. Due to the substantial changes in the housing, base and gimbal mechanisms, these parts will be referred to with new reference numbers. In contrast, except as discussed below, the loading mechanism, retainer ring, and substrate backing assembly are similar to the components discussed with reference to FIG. 4, and will be referred to with unprimed reference numbers.

Carrier head 400 includes a housing 402, a base 404, a gimbal mechanism 406, loading mechanism 108, retaining ring 110, and substrate backing assembly 112.

Housing 402 includes a housing plate 420 and an integrally-attached housing hub 422. A cylindrical cavity 426 is formed in bottom surface 424 of housing 402. A cylindrical plastic bushing 520 fits into cylindrical cavity 426 with its outer surface abutting housing 402. A circular flange 428 with an inwardly-turned lip 430 projects downwardly from a top surface 432 of housing hub 422 into cavity 426. Housing hub 422 may also have a threaded neck 434 and two vertical dowel pin holes 436. A threaded perimeter nut 98 (see FIG. 3) may fit over flange 96 and be screwed onto threaded neck 434 of housing hub 432 to secure carrier head 400 to drive shaft 74.

Housing 402 may include two torque pin holes 438 formed in its bottom surface 424 which project upwardly into housing hub 422. In addition, two passages (not shown in this cross-sectional view) also connect top surface 432 of housing hub 422 to bottom surface 424.

Base 404 is generally disk-shaped, with a basin 440 formed in an upper surface 442 thereof. Basin 440 has a flat annular surface 444 surrounding a flat-bottom depression 446. Two torque pin holes 448 may be found in upper surface 442 of base 404 surrounding basin 440.

Two vertical torque pins 450 are used to transfer torque from housing 402 to base 404. The torque pins 450 fit securely into torque pin holes 438 in housing 402 and project downwardly into receiving torque pin holes 448 in base 404. Torque pins 450 are free to slide vertically in receiving torque pin holes 448, but O-rings 452 hold each torque pin 450 in place laterally. Thus, base 404 is free to move vertically relative to housing 402, but if housing 402 rotates, then the torque pins will force the base to rotate as well. The O-rings 452 are sufficiently elastic to permit a slight pivoting of base 404 relative to housing 402.

Gimbal mechanism 406 is designed to allow base 404 to pivot, i.e. rotate about an axis parallel to the surface to the polishing pad and normal to axis of rotation 107, with respect to housing 402. Specifically, base 404 may pivot about a point located on the surface of polishing pad 32. Gimbal mechanism 402 includes a gimbal body 460, a gimbal race 462, a guide pin 464, a spring 466, a biasing member 468, and a stop 470.

Gimbal body 460 includes a cylindrical gimbal rod 472 which projects upward from a bearing base 474. Bearing base 474 includes a spherical outer surface 476 with three radial slots 478 (only one is shown in the cross-sectional view of FIG. 10) which extend from the edge of outer surface 476 to gimbal rod 472. The lower surface of bearing base 474 has a Y-shaped depression (not shown) which contains biasing member 468 when gimbal mechanism 406 is fully assembled. A cylindrical recess 480 may be formed in the bottom surface of gimbal body 460, and another cylindrical recess 482 may be formed in a top surface 484 of gimbal rod 472. Recesses 480 and 482 may be connected by a vertical passage 486.

Guide pin 464 includes a guide rod 490, a disk 492 which projects radially outwardly from the lower end of guide rod 490, and a spherical projection 494 on the bottom of disk 492. Spring 466 fits into recess 480 in the bottom of gimbal rod 472, and guide rod 490 of guide pin 464 fits inside spring 466. When the gimbal mechanism is assembled, the spring is compressed between the top of disk 492 and the upper portion 496 of recess 480.

Gimbal race 462 fits around gimbal body 460 and rests on base 404. Gimbal race 462 may include a flat outer portion 500 which rests on annular surface 444 and a wedge-shaped inner portion 502 which fits into depression 446. A spherical inner surface 504 of wedge-shaped portion 502 engages the spherical outer surface 476 of bearing base 474. Three notches 506 may be cut into inner surface 504 of gimbal race 462. Gimbal race 462 may be secured to base 404 with screws (not shown) which pass through outer piece 500 and into receiving threaded recesses in the base.

The biasing member 468 is generally Y-shaped, and includes three arms 510 which project outwardly from a central section 512. The top surface 514 of central section 512 has a circular recess 515 and a conical depression 516 at the center of the recess. The biasing member 468 fits into the Y-shaped depression (not shown) on the underside of bearing base 474. The disk 492 of guide pin 464 fits into recess 515 with its spherical projection 494 engaging conical depression 516 of biasing member 468. The arms 510 of biasing member 468 extend through slots 478 in bearing base 474 and into notches 506 in gimbal race 462. Bolts or screws 518 may be used to secure arms 510 to gimbal race 462.

Once gimbal mechanism 406 is assembled, gimbal race 462 is secured to base 404, and biasing member 468 is secured to gimbal race 462. Guide pin 464 contacts biasing member 468, and spring 466 urges gimbal body 460 upwardly away from the biasing member so that spherical outer surface 476 of bearing base 474 is pressed against spherical inner surface 504 of gimbal race 462. The gimbal rod 472 of gimbal mechanism 406 engages an inner surface 521 of bushing 520. The gimbal body 460 is free to slide vertically in cavity 426 relative to housing 402 and to pivot in two dimensions relative to gimbal race 462. When the gimbal pivots, arms 510 will slide in slots 478. However, because biasing member 468 is fixed to gimbal race 462, the downward force from spring 466 is not transmitted to carrier base 404. Because there is no outward pressure on the center of the base due to spring 466, the lower surface of the base remains substantially planar when gimbal mechanism 406 is attached.

Stop pin 470, which has a threaded lower portion 528, fits into a stop pin hole 522 defined by downwardly projecting flange 428. The stop pin extends through an aperture 523 at the bottom of the stop pin hole and is screwed into passage 486 of gimbal rod 472. The recess 482 in gimbal rod 472 fits around flange 428. A head 524 of stop pin 470 catches against lip 430 of flange 428 to limit the downward motion of gimbal mechanism 406 and base 404 relative to housing 402. The stop pin 470 may also include a vertical passage 526 to connect top surface 432 of housing 422 to passage 486 in gimbal rod 472. Pump 93*c* (see FIG. 3) may be connected via fluid line 92*c,* rotary coupling 90, central conduit 94*c* in drive shaft 74, passage 526 in stop pin 470, passage 486 and recess 480 in gimbal body 460, and slot 478 to chamber 200. Thus, in the embodiment of FIG. 10, pump 93*c* is used to control the vertical actuation of the carrier head.

Carrier head 400 may also include a slurry purge mechanism to flush slurry out from gap 296 between flexure 116 and support structure 114. The slurry purge mechanism includes a passageway 530 which extends vertically from upper surface 258 of inner portion 254 of support ring 250, radially outwardly into outer portion 252, and upwardly through lower clamp 280 of gap 296.

The slurry purge mechanism may also include a vertical passage 532 extending through base 404. A fixture 536 may be connected to the passage 532 at upper surface 442 of base 404. A fitting 534 may connect passageway 530 in base 404 to passage 532 in support ring 250. The fitting 534 may be fixedly connected to base 404, project downwardly through volume 294 of chamber 290, and be slidably disposed in passageway 530 of support ring 114. The fitting 534 may be sealed in passageway 530 by O-rings 538.

Pump 93*b* may be connected to passageway 530 via fluid line 92*b,* rotary coupling 90, channel 94*b* in drive shaft 74, a passage through housing 402 (not shown), a flexible fluid coupling (also not shown) such as a plastic tube, passageway 532 in base 404, and fitting 534. Pump 92*b* may force a liquid, e.g. deionized water, through passageway 530 to flush slurry from gap 296.

Pump 93*a* may be connected to chamber 290 via fluid line 92*a,* rotary coupling 90, channel 94*a* in drive shaft 74, a passage through housing 402 (not shown), a flexible fluid coupling (not shown), and a passage through base 404 (also not shown). Pump 93*a* may be used to control the pressure in chamber 290.

In summary, the carrier head of the present invention suspends a support structure from the base of a carrier head by means of a flexure. A flexible membrane is connected to and extends below the support structure to define a chamber. By pressurizing the chamber, an even load can be applied across the substrate. In addition, the flexure allows the support structure, and thus the entire flexible membrane, to pivot and move vertically with respect to the base. Thus, the load is applied more uniformly across the entire back side of the substrate.

The present invention has been described in terms of the preferred embodiment. The invention, however, is not limited to the embodiments depicted and described. Rather, the scope of the invention is defined by the appended claims.

What is claimed is:

1. A carrier head for a chemical mechanical polishing apparatus, comprising:

a retaining ring;

a support structure having a surface to receive a substrate; and a fluid source to introduce a fluid into a gap between the retaining ring and the support structure and force a slurry out of the gap.

2. The carrier head of claim 1, wherein a passage connects an exterior surface of the retaining ring to the gap.

3. The carrier head of claim 1, further comprising a flexure connecting the support structure to a base to permit relative vertical movement, the gap extending between the flexure and the support structure.

4. The carrier head of claim 1, wherein the support structure includes a flexible membrane having a mounting surface for a substrate.

5. The carrier head of claim 4, further comprising a chamber having a boundary defined by the flexible membrane.

6. The carrier head of claim 1, further comprising a passage through the support structure to transort fluid to the gap.

7. The carrier head of claim 6, wherein the support structure is movably connected to a base that has a channel.

8. The carrier head of claim 7, further comprising a fitting to fluidly couple the passage through the support structure to the channel in the base.

9. The carrier head of claim 1, wherein the support structure is vertically movable relative to the retaining ring.

10. A method of cleaning a carrier head, comprising:

introducing a fluid into a gap between a retaining ring and a support structure that is vertically movable relative to the retaining ring to force a slurry out of the gap.

* * * * *